US009273524B2

(12) United States Patent
Reddy et al.

(10) Patent No.: US 9,273,524 B2
(45) Date of Patent: Mar. 1, 2016

(54) DRILLING RIG CARRIAGE MOVABLE ALONG RACKS AND INCLUDING PINIONS DRIVEN BY ELECTRIC MOTORS

(71) Applicant: Nabors Drilling International Limited, Hamilton (BM)

(72) Inventors: Padira Reddy, Richmond, TX (US); Ashish Gupta, Houston, TX (US); Sean M. Bailey, Willis, TX (US); Richmond Todd Fox, Cypress, TX (US); Scott G. Boone, Houston, TX (US); Beat Kuttel, Spring, TX (US)

(73) Assignee: Nabors Drilling International Limited, Hamilton (BM)

( * ) Notice: Subject to any disclaimer, the term of this patent is extended or adjusted under 35 U.S.C. 154(b) by 410 days.

(21) Appl. No.: 13/797,265

(22) Filed: Mar. 12, 2013

(65) Prior Publication Data

US 2013/0299190 A1 Nov. 14, 2013

Related U.S. Application Data

(60) Provisional application No. 61/646,686, filed on May 14, 2012.

(51) Int. Cl.

| | |
|---|---|
| ***E21B 3/02*** | (2006.01) |
| ***E21B 19/083*** | (2006.01) |
| ***E21B 19/08*** | (2006.01) |

(Continued)

(52) U.S. Cl.

CPC . *E21B 19/08* (2013.01); *E21B 3/02* (2013.01); *E21B 15/00* (2013.01); *E21B 19/06* (2013.01); *E21B 19/083* (2013.01); *E21B 19/14* (2013.01)

(58) Field of Classification Search

CPC ..... E21B 19/083; E21B 3/02

See application file for complete search history.

(56) References Cited

U.S. PATENT DOCUMENTS

| | | | |
|---|---|---|---|
| 2,792,198 | A | 5/1957 | Braun |
| 3,650,339 | A | 3/1972 | Selfe et al. |

(Continued)

FOREIGN PATENT DOCUMENTS

| | | | |
|---|---|---|---|
| EP | 0548900 | A2 | 6/1993 |
| WO | WO 2005/073471 | A1 | 8/2005 |

(Continued)

OTHER PUBLICATIONS

PCT, PCT/US2013/039695, The International Search Report and Written Opinion, Apr. 2, 2014.

*Primary Examiner* — Giovanna C Wright

(74) *Attorney, Agent, or Firm* — Haynes and Boone LLP

(57) ABSTRACT

According to one aspect, a drilling rig carriage is adapted to move along a drilling mast, and includes a body structure, electric motors coupled to the body structure, and pinions operably coupled to the electric motors, respectively. The pinions are adapted to engage racks, respectively. According to another aspect, a drilling mast includes a longitudinally-extending frame having a first side portion and a second side portion spaced therefrom. Racks are coupled to the frame at the first side portion thereof. According to yet another aspect, an apparatus includes a drilling mast or tower extending longitudinally along an axis, the tower including racks spaced in a parallel relation. A top drive is movable along the axis and relative to the tower. Electric motors are coupled to the top drive and movable therewith. Pinions are operably coupled to the electric motors, respectively, and engage the racks, respectively, to move the top drive.

14 Claims, 22 Drawing Sheets

(51) Int. Cl.

| | |
|---|---|
| ***E21B 19/06*** | (2006.01) |
| ***E21B 15/00*** | (2006.01) |
| ***E21B 19/14*** | (2006.01) |

(56) References Cited

U.S. PATENT DOCUMENTS

| | | | | |
|---|---|---|---|---|
| 4,203,576 | A | 5/1980 | Sutton | |
| 4,586,572 | A | 5/1986 | Myers et al. | |
| 4,718,805 | A | 1/1988 | Becker | |
| 4,843,945 | A | 7/1989 | Dinsdale | |
| 5,423,390 | A | 6/1995 | Donnally et al. | |
| 7,134,513 | B1 * | 11/2006 | Randall et al. | 175/122 |
| 7,255,180 | B2 | 8/2007 | Beato et al. | |
| 7,318,491 | B2 | 1/2008 | Riel | |
| 7,347,285 | B2 | 3/2008 | Hamner | |
| 7,744,327 | B2 | 6/2010 | Lops et al. | |
| 7,905,300 | B2 | 3/2011 | Rieder et al. | |
| 8,033,345 | B1 | 10/2011 | Randall et al. | |
| 8,046,959 | B2 | 11/2011 | Stoetzer et al. | |
| 8,052,370 | B2 | 11/2011 | Dekker et al. | |
| 8,157,495 | B1 | 4/2012 | Randall | |
| 8,671,626 | B1 * | 3/2014 | Marty et al. | 52/117 |
| 2005/0241857 | A1 | 11/2005 | Beato et al. | |
| 2008/0053704 | A1 | 3/2008 | Zachariasen et al. | |
| 2008/0251267 | A1 | 10/2008 | Cicognani | |
| 2009/0053015 | A1 | 2/2009 | Zachariasen et al. | |
| 2009/0196712 | A1 | 8/2009 | Mortensen et al. | |
| 2010/0193247 | A1 | 8/2010 | Riddle et al. | |
| 2010/0230166 | A1 | 9/2010 | Sigmar et al. | |
| 2010/0319999 | A1 * | 12/2010 | Haughom | 175/203 |
| 2010/0329823 | A1 | 12/2010 | Baumler et al. | |
| 2011/0148133 | A1 | 6/2011 | Hessels et al. | |
| 2011/0188973 | A1 | 8/2011 | Baumler | |
| 2011/0214917 | A1 | 9/2011 | Boudreaux | |
| 2011/0240371 | A1 | 10/2011 | Murr et al. | |
| 2011/0247290 | A1 | 10/2011 | Beck et al. | |
| 2012/0097454 | A1 | 4/2012 | Kockeis et al. | |
| 2012/0103623 | A1 | 5/2012 | Wijning et al. | |
| 2013/0299189 | A1 | 11/2013 | Reddy et al. | |
| 2013/0299244 | A1 | 11/2013 | Reddy et al. | |
| 2013/0302114 | A1 | 11/2013 | Reddy et al. | |
| 2013/0327543 | A1 * | 12/2013 | Reddy et al. | 166/381 |

FOREIGN PATENT DOCUMENTS

| | | | |
|---|---|---|---|
| WO | WO 2005/073495 | A1 | 8/2005 |
| WO | WO 2005/073497 | A1 | 8/2005 |
| WO | WO 2011/016719 | A1 | 2/2011 |
| WO | WO 2011/120627 | A2 | 10/2011 |
| WO | WO 2012/032384 | A1 | 3/2012 |

* cited by examiner

DRILLING RIG CARRIAGE MOVABLE ALONG RACKS AND INCLUDING PINIONS DRIVEN BY ELECTRIC MOTORS

CROSS-REFERENCE TO RELATED APPLICATION

This application claims the benefit of and priority to U.S. Provisional Application No. 61/646,686 filed May 14, 2012, entitled "Drilling Rig and Methods," to Reddy et al., the entire disclosure of which is hereby incorporated herein by reference.

BACKGROUND OF THE DISCLOSURE

The present disclosure relates in general to drilling rigs, and in particular to a drilling rig employing a carriage movable along racks and including pistons driven by electric motors. In several exemplary embodiments, a top drive is coupled to the carriage.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
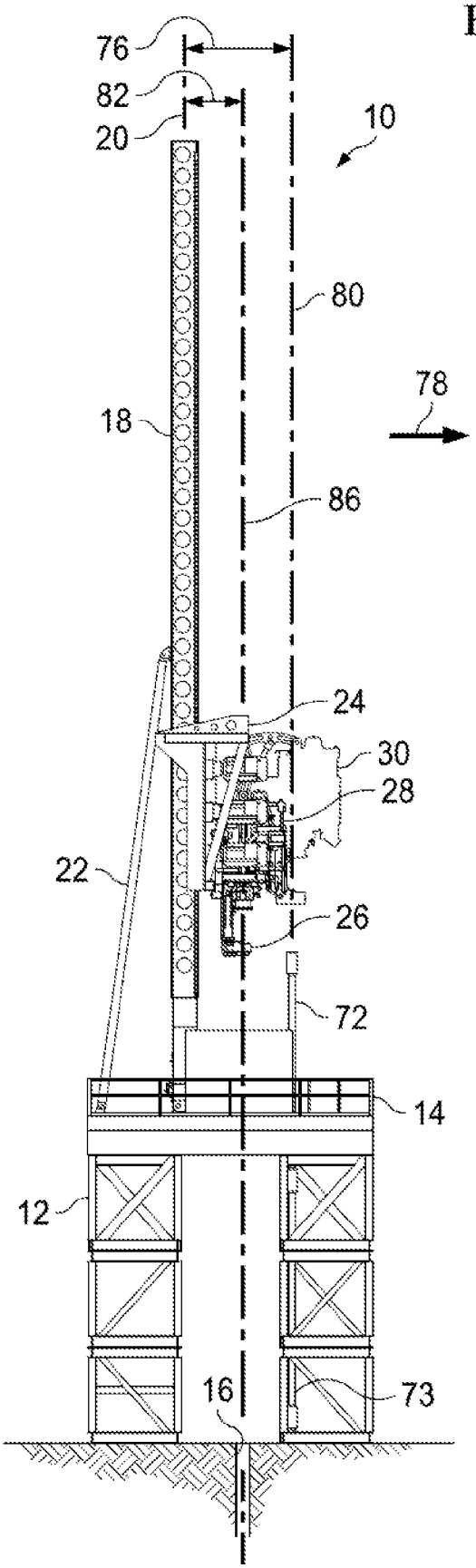
FIG. 1 is a side elevational view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is an elevational view of an apparatus 10. The apparatus 10 may be, include, or be part of, a land-based drilling rig. In several exemplary embodiments, instead of a land-based drilling rig, the apparatus 10 may be, include, or be part of, any type of drilling rig, such as a jack-up rig, a semi-submersible rig, a drill ship, a coil tubing rig, a platform rig, a slant rig, or a casing drilling rig, among others. The apparatus 10 includes a platform 12, which includes a rig floor 14 that is positioned adjacent or above a wellbore 16. In several exemplary embodiments, the platform 12 may be, include, or be a part of, one or more of several types of platforms. A drilling mast or tower 18 is coupled to the platform 12, and extends longitudinally along an axis 20. In one embodiment, the tower 18 is releasably coupled. A support member 22 extends between the platform 12 and the tower 18. A drilling carriage 24 is movably coupled to the tower 18. A top drive 26 is coupled to the carriage 24. The top drive 26 extends longitudinally in a parallel relation to the tower 18. As will be described in further detail below, the carriage 24 and the top drive 26 coupled thereto are movable along the axis 20, relative to the tower 18. As will be described in further detail below, the top drive 26 is movable, relative to the tower 18, between positions 28 and 30, as shown in FIG. 1. In several exemplary embodiments, the apparatus 10 does not include the top drive 26; instead, the apparatus 10 may be, include, or be a part of, another type of drilling rig such as, for example, a rotary-swivel rig or a power-swivel rig.

Figure 2:
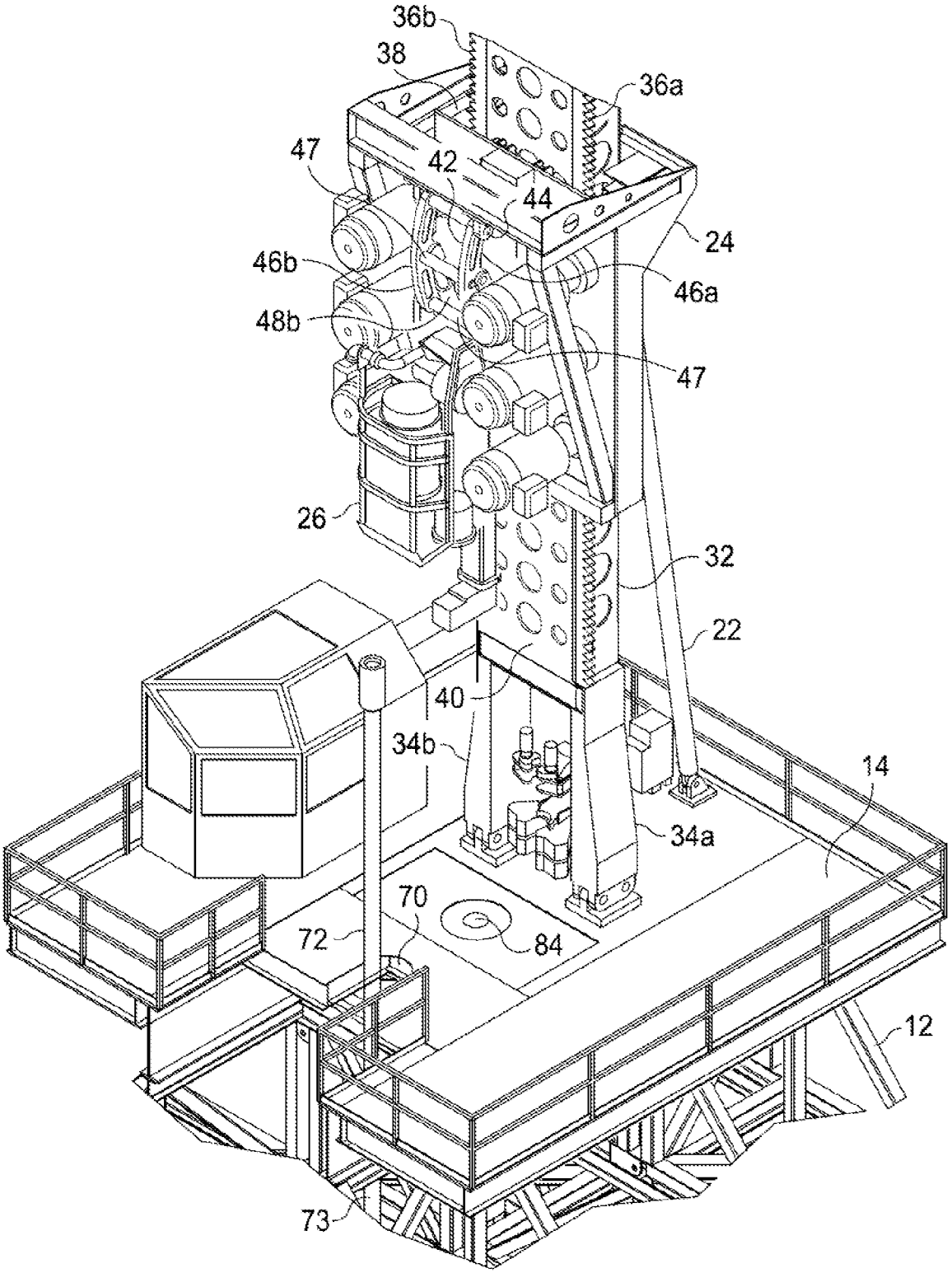
FIG. 2 is a perspective view of a portion of the apparatus shown in FIG. 1 according to one or more aspects of the present disclosure.
Figure 3:
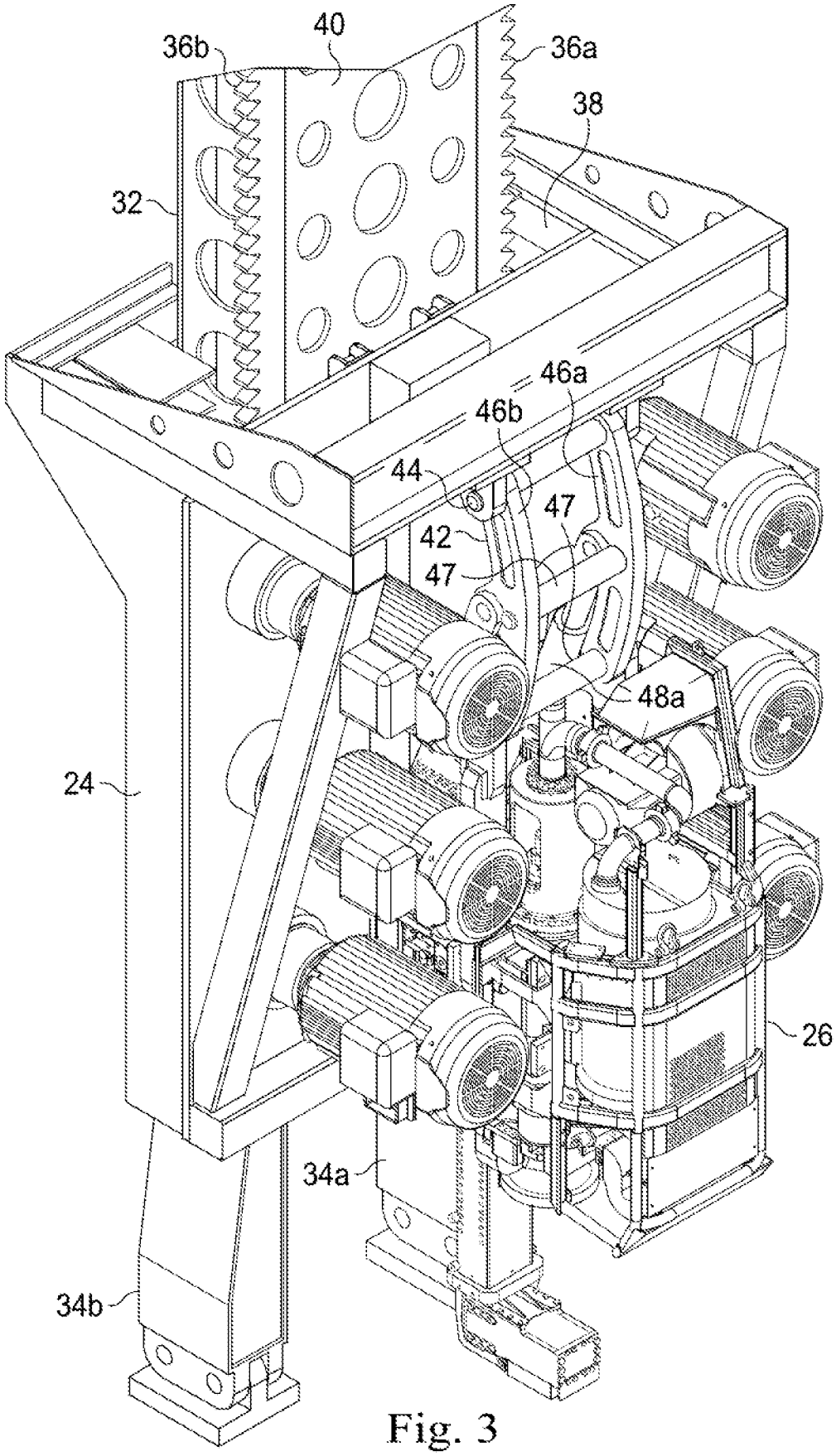
FIG. 3 is a perspective view of a portion of the apparatus shown in FIG. 1 according to one or more aspects of the present disclosure.

Referring to FIGS. 2 and 3, illustrated are perspective views of portions of the apparatus 10. The tower 18 includes a frame 32 and support legs 34*a* and 34*b*, which extend between the frame 32 and the rig floor 14. Racks 36*a* and 36*b* are coupled to opposing sides of the frame 32. In another embodiment (not shown), the racks 36*a* and 36*b* are coupled to the frame 32 by being integrally formed with the frame 32. The racks 36*a* and 36*b* are spaced in a parallel relation and face away from each other. The racks 36*a* and 36*b* extend through an opening 38 defined by the carriage 24. The frame 32 includes a front panel 40, which extends between the racks 36*a* and 36*b*. A linking member 42 is pivotally coupled to the carriage 24 at a pivot connection 44. The linking member 42 includes parallel-spaced arcuate members 46*a* and 46*b*, and a plurality of transversely-extending members 47 extending therebetween. Actuators 48*a* and 48*b* extend angularly between the carriage 24 and the arcuate members 46*a* and 46*b*, respectively. In an exemplary embodiment, the actuators 48*a* and 48*b* are hydraulic cylinders. In several exemplary embodiments, each of the actuators 48*a* and 48*b* is, includes, or is part of, a hydraulic actuator, an electromagnetic actuator, a pneumatic actuator, a linear actuator, and/or any combination thereof.

Figure 4:
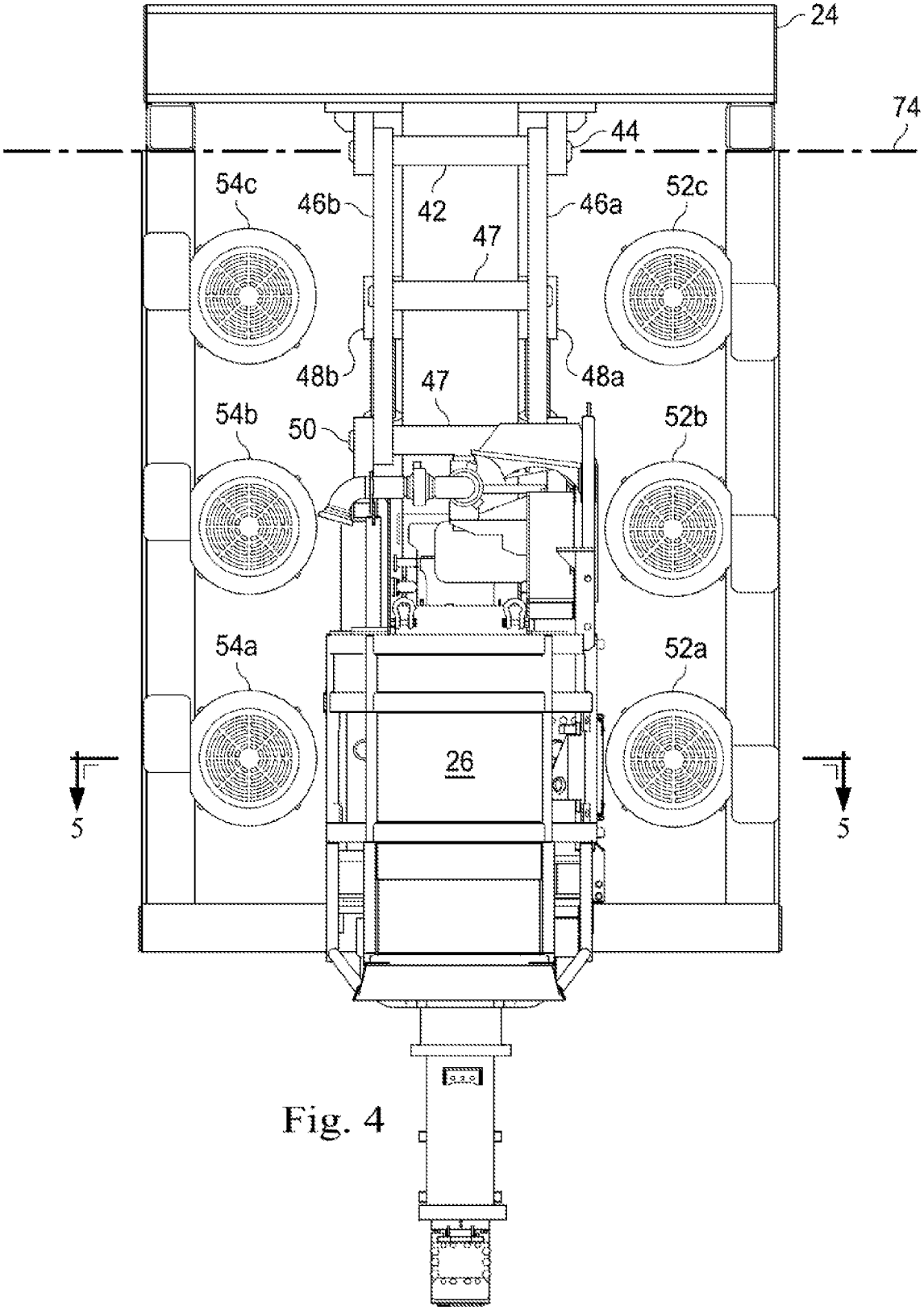
FIG. 4 is a front elevational view of a portion of the apparatus shown in FIG. 1 according to one or more aspects of the present disclosure.

Referring to FIG. 4, illustrated is an elevational view of a portion of the apparatus 10. As shown in FIG. 4, the top drive 26 is pivotally coupled to the linking member 42 at a pivot connection 50. Electric motors 52*a*, 52*b* and 52*c* are coupled to the carriage 24 and thus also to the top drive 26. Likewise, electric motors 54*a*, 54*b* and 54*c* are coupled to the carriage 24 and thus also to the top drive 26, and are spaced from the electric motors 52*a*, 52*b* and 52*c* in a direction that is perpendicular to the axis 20. In an exemplary embodiment, each of the electric motors 52*a*-52*c* and 54*a*-54*c* is an AC motor and is controlled by either a single variable-frequency drive (VFD) or multiple VFDs, which is/are synchronized and programmed to work simultaneously with the other motors to provide uniform motion and torque. In an exemplary embodiment, one or more of the electric motors 52*a*-52*c* and 54*a*-54*c* are controlled by a single VFD. In an exemplary embodiment, one or more the electric motors 52*a*-52*c* and 54*a*-54*c* are controlled by multiple VFDs. In an exemplary embodiment, each of the electric motors 52*a*-52*c* and 54*a*-54*c* is an AC motor and provides primary dynamic braking. In an exemplary embodiment, each of the electric motors 52*a*-52*c* and 54*a*-54*c* includes a gearbox and a brake therein or thereat. In an exemplary embodiment, each of the electric motors 52*a*-52*c* and 54*a*-54*c* includes an encoder incorporated on the motor shaft to provide more precise VFD control.

Figure 5:
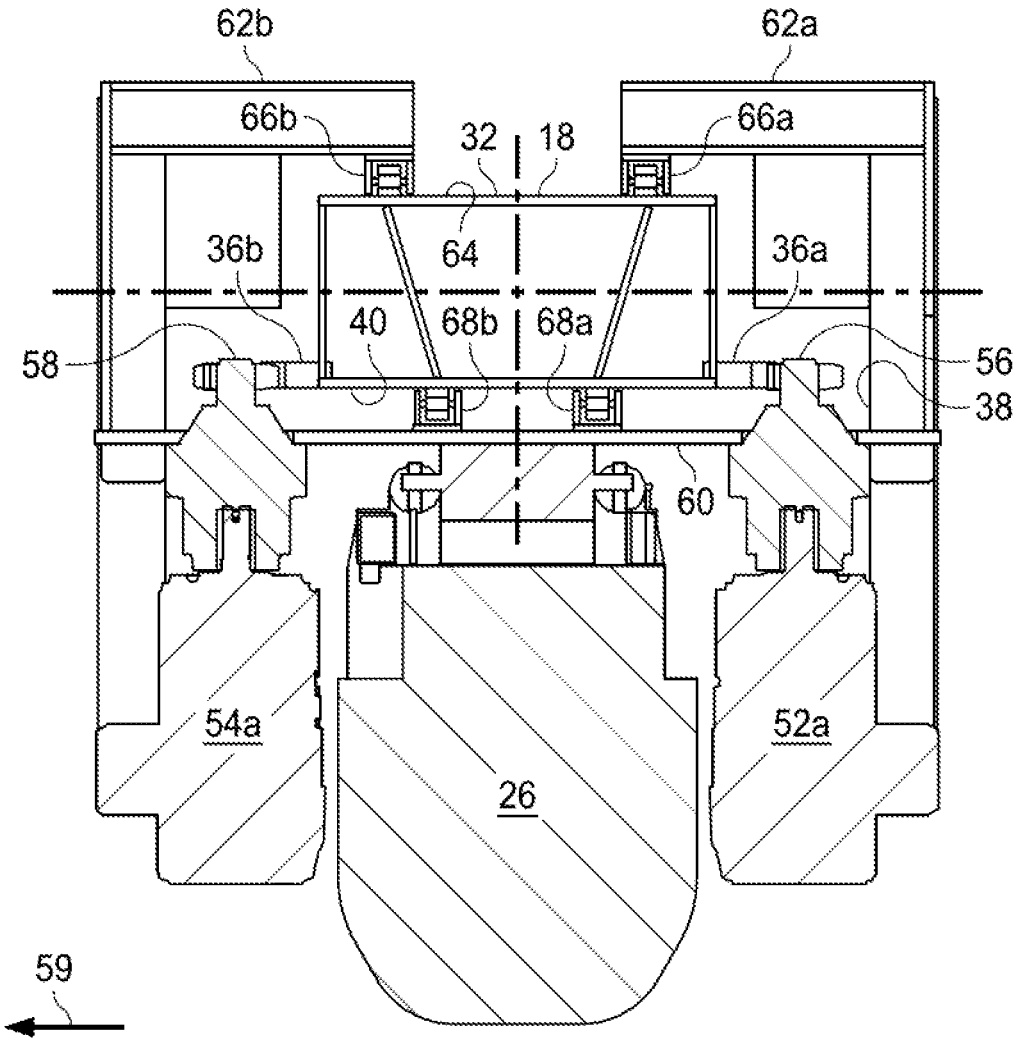
FIG. 5 is a section view taken along line 5-5 of FIG. 4 according to one or more aspects of the present disclosure.
Figure 6:
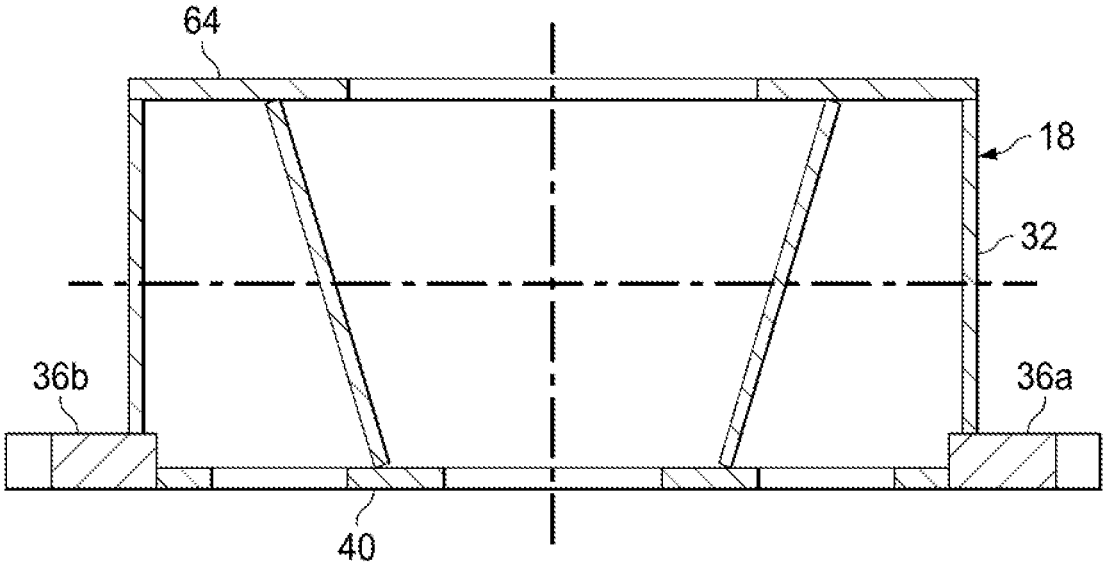
FIG. 6 is a section view of a component of the apparatus shown in FIG. 1 according to one or more aspects of the present disclosure.

Referring to FIGS. 5 and 6, illustrated are a section view taken along line 5-5 of FIG. 4, and a section view of the frame 32, respectively. A pinion 56 is operably coupled to the electric motor 52*a*. The pinion 56 is engaged with the rack 36*a*. Likewise, a pinion 58 is operably coupled to the electric motor 54*a*. The pinion 58 is engaged with the rack 36*b*, and is spaced from the pinion 56 in a direction 59 that is perpendicular to the axis 20. As shown in FIG. 5, the carriage 24 includes a center portion 60 and guide portions 62*a* and 62*b* extending therefrom. The guide portion 62*a* extends past the rack 36*a*, and wraps around the frame 32 to engage a panel 64 of the frame 32 via a guide element 66*a*. Similarly, the guide portion 62*b* extends past the rack 36*b* and wraps around the frame 32 to engage the panel 64 via a guide element 66*b*. The electric motors 52*a*-52*c* and 54*a*-54*c* are coupled to the center portion 60 of the carriage 24. The center portion 60 engages the panel 40 of the frame 32 via guide elements 68*a* and 68*b*.

Figure 7:
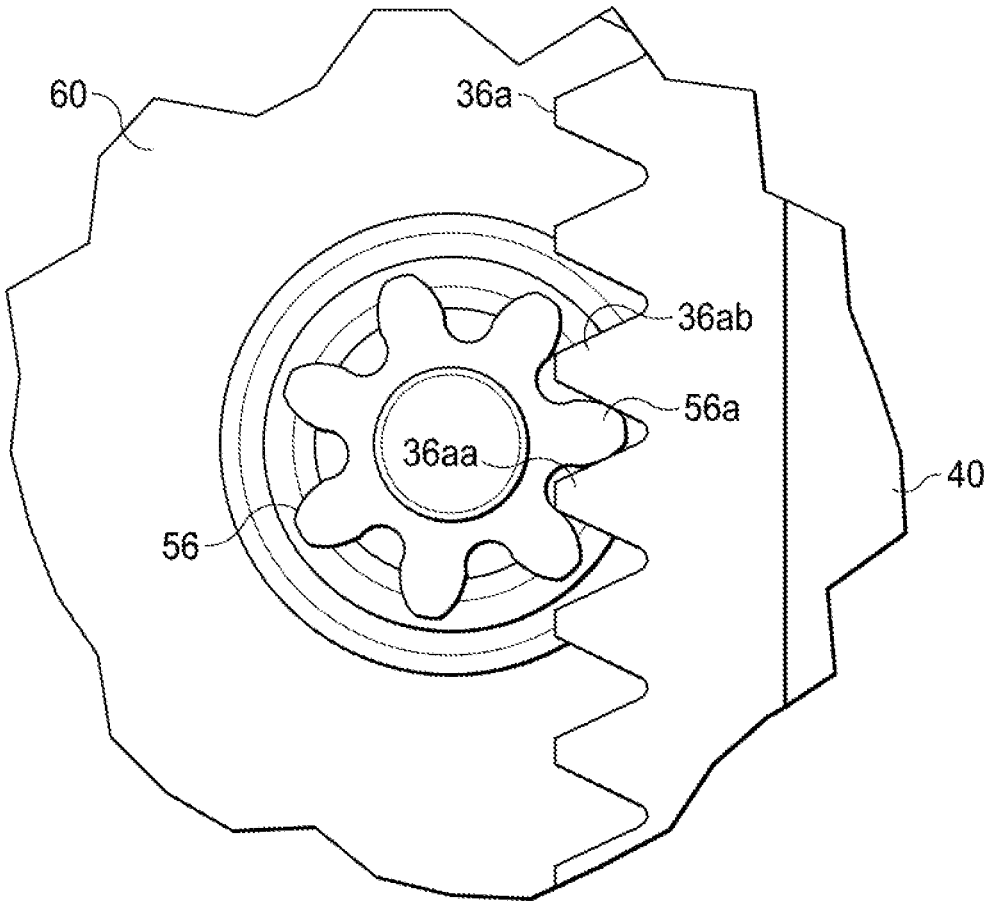
FIG. 7 is a rear elevational view of components of the apparatus shown in FIG. 1 according to one or more aspects of the present disclosure.

Referring to FIG. 7, illustrated is a rear elevational view of respective portions of the pinion 56, the rack 36*a*, the center portion 60 of the carriage 24, and the panel 40 of the frame 32 of the tower 18. As shown in FIG. 7, a tooth 56*a* of the pinion 56 extends between, and engages, adjacent teeth 36*aa* and 36*ab* of the rack 36*a*. Although not shown in the figures, pinions, each of which is substantially identical to the pinion 56, are operably coupled to the electric motors 52*b* and 52*c*, respectively, and engage the rack 36*a*. Similarly, pinions, each of which is substantially identical to the pinion 58, are operably coupled to the electric motors 54*b* and 54*c*, respectively, and engage the rack 36*b*.

In operation, in an exemplary embodiment with continuing reference to FIGS. 1-7, the apparatus 10 is employed to assemble a string of tubular members (or tubulars), such as drill pipe or casing as part of oil and gas exploration and production operations. More particularly, at least one tubular member is temporarily coupled to the top drive 26, which operates to couple (or separate) that tubular member to (or from) another tubular member which already extends within the wellbore 16 or is vertically positioned between the wellbore 16 and the tubular member coupled to the top drive 26. For all embodiments described herein, the operations disclosed herein may be conducted in reverse to trip pipe or casing out of a wellbore and disassemble tubular members or pairs of tubular members from the string of tubular members. For example, as shown in FIG. 2, an opening 70 is formed in the platform 12, and the opening 70 receives a tubular member 72 from a tubular handling device (not shown). As shown in FIGS. 1 and 2, a tubular member 73 may be coupled to the tubular member 72, and the top drive 26 may be employed to couple both the tubular members 72 and 73 to another tubular member which already extends within the wellbore 16 or is vertically positioned between the wellbore 16 and the tubular member 73; this other tubular member may be part of a string of drill pipe or casing.

The electric motors 52*a*-52*c* cause the respective pinions operably coupled thereto, including the pinion 56, to rotate and engage teeth of the rack 36*a*. Likewise, the electric motors 54*a*-54*c* cause the respective pinions operably coupled thereto, including the pinion 58, to rotate and engage teeth of the rack 36*b*. As a result, the carriage 24 and thus the top drive 26 move along the axis 20 and relative to the tower 18 as necessary so that the top drive 26 is at a position along the axis 20 at which the tubular member 72 can be coupled to the top drive 26. Before, during or after the top drive 26 is at that position along the axis 20, the actuators 48*a* and 48*b* actuate, extending their respective lengths. As a result, the linking member 42 pivots about an axis 74 (shown in FIG. 4), which extends through the pivot connection 44 and is perpendicular to the axis 20. As viewed in FIG. 1, the linking member 42 pivots in a counterclockwise direction about the axis 74. The linking member 42 pivots from a pivot position corresponding to respective retracted positions of the actuators 48*a* and 48*b*, to a pivot position corresponding to respective extended positions of the actuators 48*a* and 48*b*. During this pivoting, the pivot connection 50 pivots about the pivot connection 44 in a counterclockwise direction, as viewed in FIG. 1. Since the top drive 26 is pivotally coupled to the linking member 42 at the pivot connection 50, the top drive 26 continues to extend longitudinally in a parallel relation to the tower 18 when the linking member 42 pivots.

As a result of the extension of the actuators 48*a* and 48*b* and thus the pivoting of each of the linking member 42 and the top drive 26, the top drive 26 moves between the position 28 and the position 30, which positions are shown in FIG. 1. Thus, the top drive 26 is spaced from the tower 18 by a spacing 76, the spacing 76 extending in a direction 78 that is perpendicular to the axis 20. An axis 80 is defined by the opening 70, and is spaced in a parallel relation from the axis 20 by the spacing 76. After the top drive 26 is at the position 30, the top drive 26 moves downward along the axis 80 and couples to the tubular member 72. The electric motors 52*a*-52*c* and 54*a*-54*c* move the top drive 26 upward along the axis 80 and relative to the tower 18, lifting the tubular member 72 and the tubular member 73 coupled thereto.

After the tubular member 73 has vertically cleared the rig floor 14, the actuators 48*a* and 48*b* are actuated to their respective retracted positions. To be clear, the vertical clearance should be sufficient to provide clearance of the tubular member 73 even if it is lowered slightly as the top drive 26 returns to the position 28; alternatively, it is desired to have a corresponding upward movement of the top drive 26 along the axis 80 as the top drive 26 returns to the position 28 as further discussed below. As a result, the linking member 42 pivots about the axis 74. As viewed in FIG. 1, the linking member 42 pivots in a clockwise direction about the axis 74. Since the top drive 26 is pivotally coupled to the linking member 42 at the pivot connection 50, the top drive 26 continues to extend longitudinally in a parallel relation to the tower 18 when the linking member 42 pivots. As a result of the retraction of the actuators 48*a* and 48*b* and thus the pivoting of each of the linking member 42 and the top drive 26, the top drive 26 is spaced from the tower 18 by a spacing 82, the spacing 82 extending in the direction 78. The spacing 82 is less than the spacing 76. In an exemplary embodiment, as a result of the retraction of the actuators 48*a* and 48*b* and thus the pivoting of the linking member 42 and the top drive 26, the top drive 26 moves from the position 30 and back to the position 28. In several exemplary embodiments, as a result of the retraction of the actuators 48*a* and 48*b* and thus the pivoting of the linking member 42 and the top drive 26, the top drive 26 moves from the position 30 and back to a position located between the positions 28 and 30 in the direction 78.

The electric motors 52*a*-52*c* and 54*a*-54*c* move the top drive 26 downward along the axis 20 and relative to the tower 80, lowering the tubular members 72 and 73 through an opening 84 formed in the platform 12. The opening 84 defines an axis 86, which is spaced in a parallel relation from the axis 20 by the spacing 82. The axis 86 is generally coaxial with the wellbore 16. Before, during or after the lowering of the tubular members 72 and 73, the top drive 26 operates to couple the tubular member 73 to another tubular member either extending in the wellbore 16 or being vertically positioned between the wellbore 16 and the tubular member 73; this other tubular member may be part of a string of drill pipe or casing. In several exemplary embodiments, during or after the lowering of the tubular members 72 and 73, the top drive 26 is positioned at the position 28 shown in FIG. 1, or at a position located between the positions 28 and 30 in the direction 78.

In an exemplary embodiment, the motors 52*c* and 54*c* may be omitted from the apparatus 10. In an exemplary embodiment, the motors 52*b*, 52*c*, 54*b* and 54*c* may be omitted from the apparatus 10. In an exemplary embodiment, in addition to the motors 52*a*-52*c* and 54*a*-54*c*, one or more additional electric motors may be coupled to the carriage 24 and employed to move the top drive 26.

Figure 8:
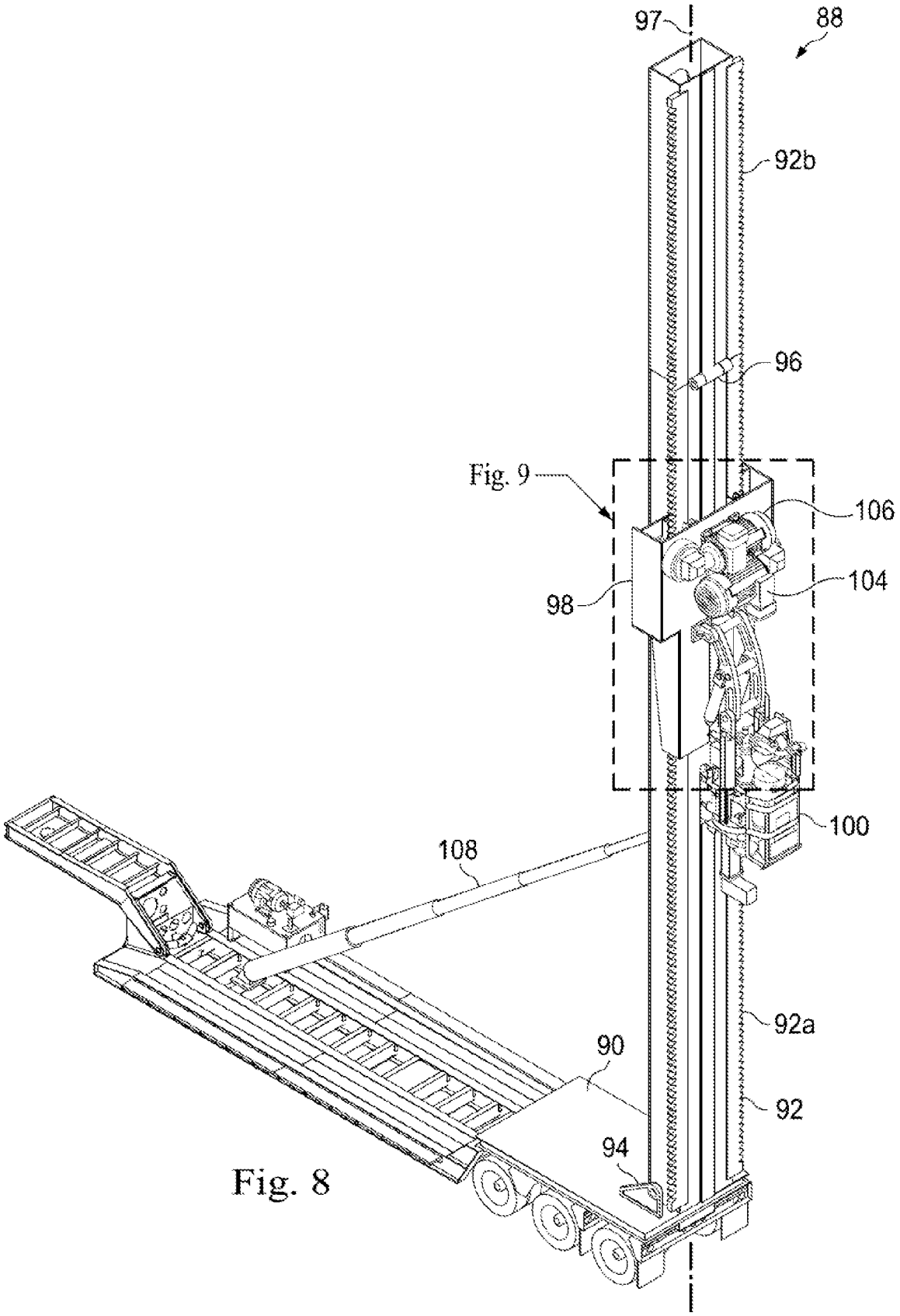
FIG. 8 is a perspective view of an apparatus according to one or more aspects of the present disclosure.

Referring to FIG. 8, illustrated is a perspective view of an apparatus 88, which includes a base 90 and a drilling mast or tower 92 pivotally coupled thereto at a pivot connection 94. In an exemplary embodiment, the base 90 is part of, or is mounted on, a mobile trailer. The tower 92 includes a portion 92*a* and a portion 92*b* pivotally coupled thereto at a pivot connection 96. The portion 92*a* extends longitudinally along an axis 97. When the portion 92*b* is in the pivot position shown in FIG. 8, the portion 92*b* also extends longitudinally along the axis 97. A carriage 98 is movably coupled to the tower 92. A top drive 100 is coupled to the carriage 98. The top drive 100 extends longitudinally in a parallel relation to the tower 92. In several exemplary embodiments, the apparatus 88 does not include the top drive 100; instead, the apparatus 88 may be, include, or be a part of, another type of drilling rig such as, for example, a rotary-swivel rig or a power-swivel rig.

Electric motors 104 and 106 are coupled to the carriage 98 and thus to the top drive 100. The electric motors 104 and 106 are vertically spaced from each other in a direction that is parallel to the axis 97. In an exemplary embodiment, each of the electric motors 104 and 106 is an AC motor and is controlled by either a single variable-frequency drive (VFD) or multiple VFDs, which is/are synchronized and programmed to work simultaneously with the other motors to provide uniform motion and torque. In an exemplary embodiment, one or more of the electric motors 104 and 106 are controlled by a single VFD. In an exemplary embodiment, one or more the electric motors 104 and 106 are controlled by multiple VFDs. In an exemplary embodiment, each of the electric motors 104 and 106 is an AC motor and provides primary dynamic braking. In an exemplary embodiment, each of the electric motors 104 and 106 includes a gearbox and a brake therein or thereat. In an exemplary embodiment, each of the electric motors 104 and 106 includes an encoder incorporated on the motor shaft to provide more precise VFD control. A telescoping support member 108 extends between the base 90 and the portion 92*a* of the tower 92.

Figure 9:
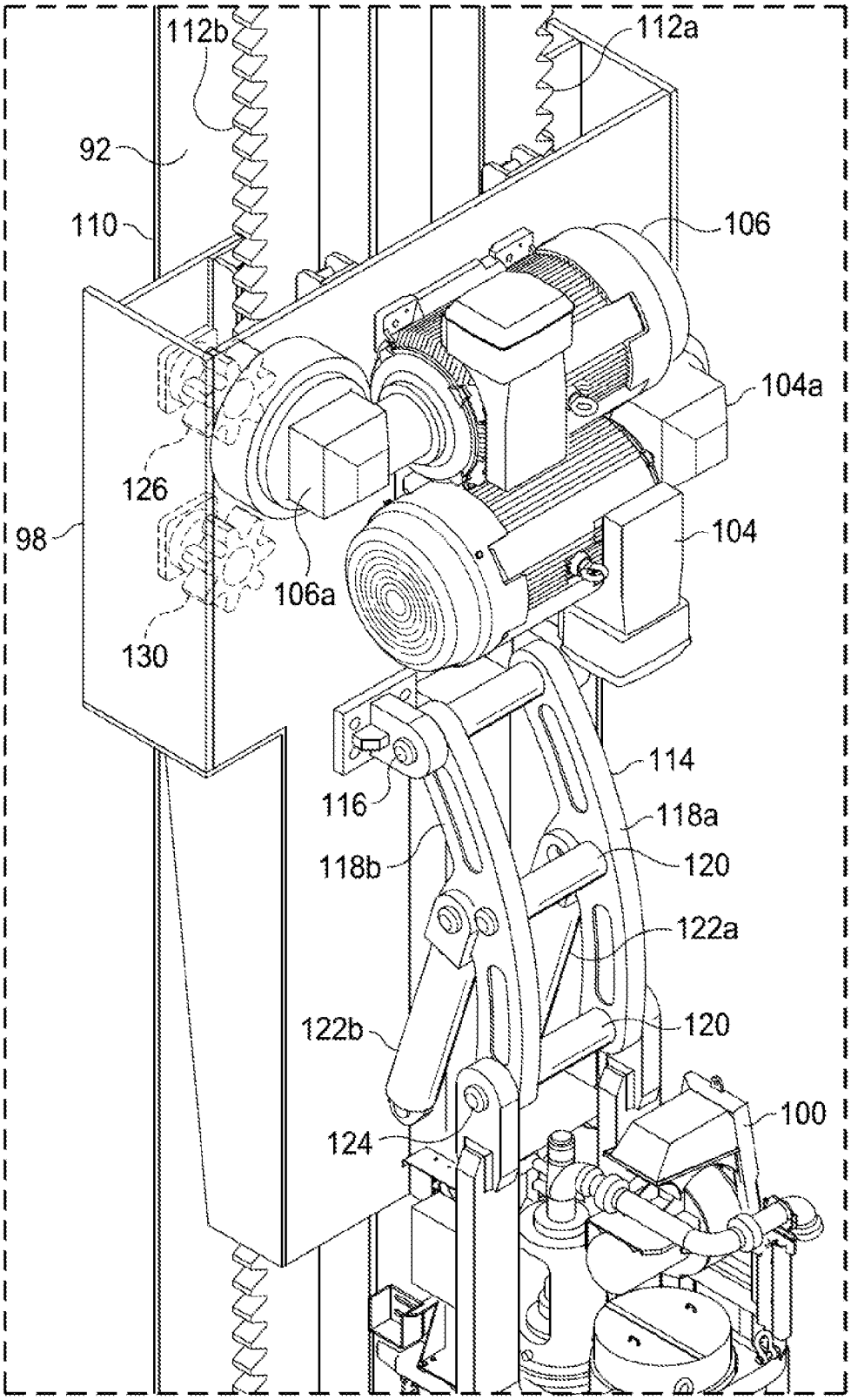
FIG. 9 is an enlarged view of a portion of the apparatus shown in FIG. 8 according to one or more aspects of the present disclosure.
Figure 10:
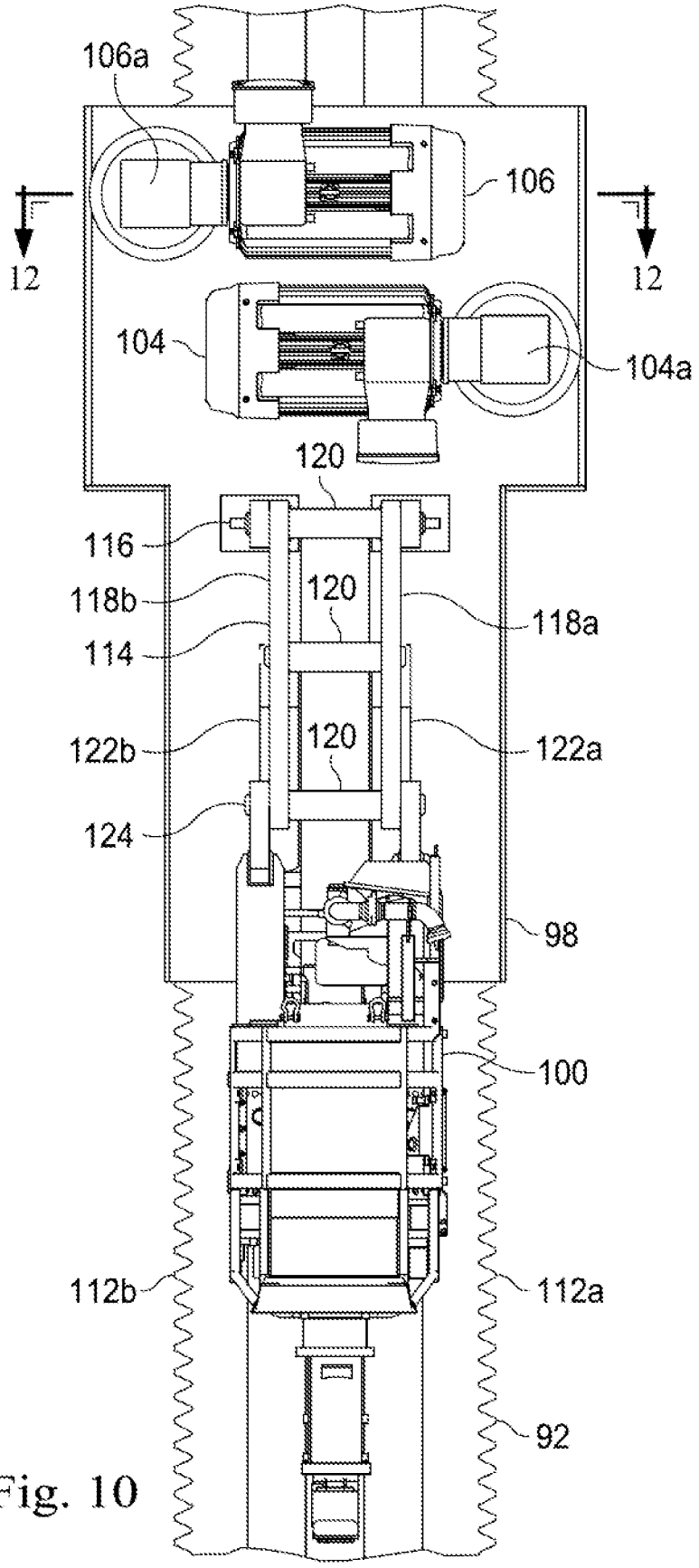
FIG. 10 is a front elevational view of a portion of the apparatus shown in FIG. 8 according to one or more aspects of the present disclosure.
Figure 11:
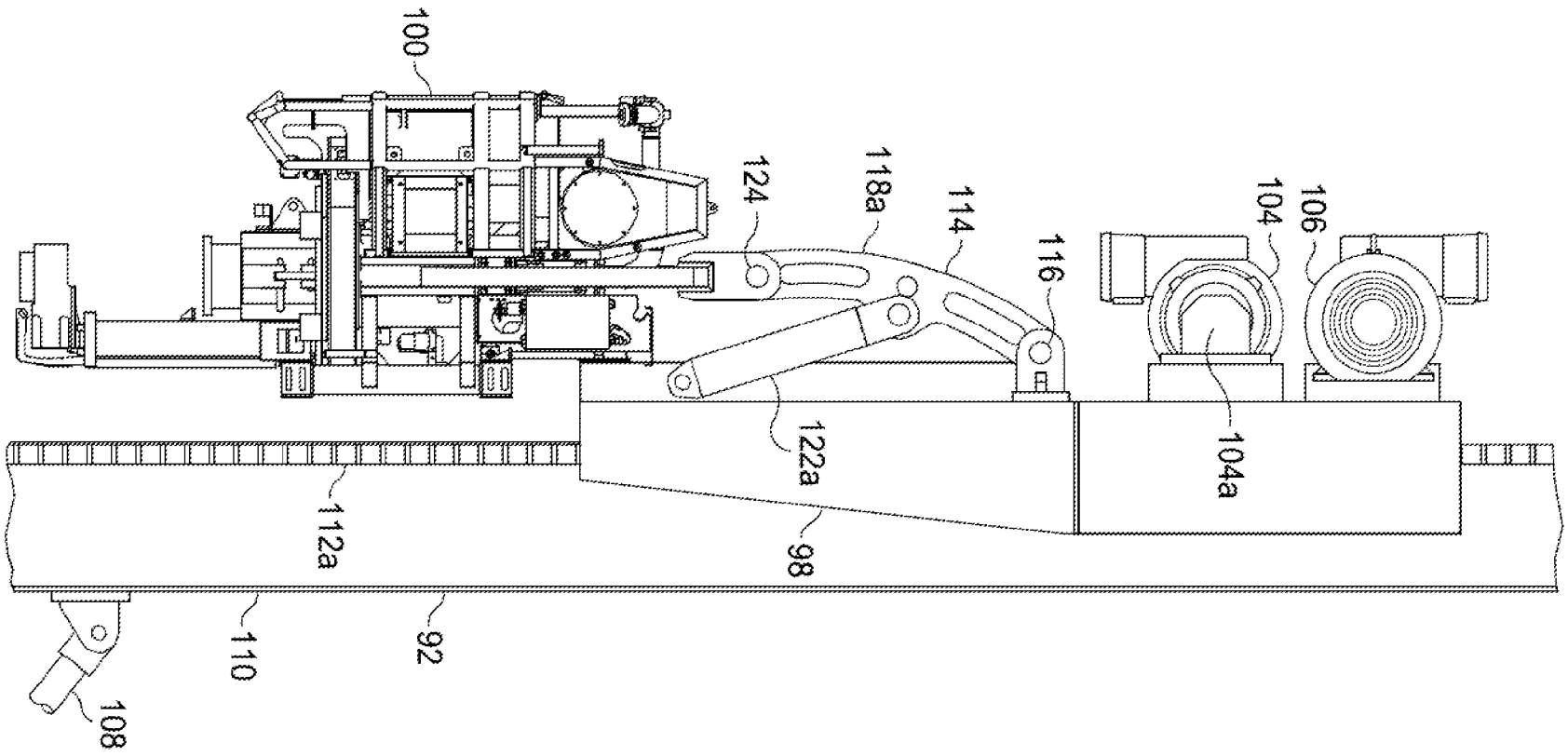
FIG. 11 is a side elevational view of the portion shown in FIG. 10 according to one or more aspects of the present disclosure.

Referring to FIGS. 9, 10 and 11, illustrated are perspective and elevational views of a portion of the apparatus 88. The tower 92 includes a frame 110, and racks 112*a* and 112*b* coupled to opposing sides of the frame 110. In another embodiment, the racks 112*a* and 112*b* are coupled to the frame 110 by being integrally formed with the frame 110. The racks 112*a* and 112*b* are spaced in a parallel relation and face away from each other. A linking member 114 is pivotally coupled to the carriage 98 at a pivot connection 116. The linking member 114 includes parallel-spaced arcuate members 118*a* and 118*b*, and a plurality of transversely-extending members 120 extending therebetween. Actuators 122*a* and 122*b* extend angularly between the carriage 98 and the arcuate members 118*a* and 118*b*, respectively. In an exemplary embodiment, the actuators 122*a* and 122*b* are hydraulic cylinders. In several exemplary embodiments, each of the actuators 122*a* and 122*b* is, includes, or is part of, a hydraulic actuator, an electromagnetic actuator, a pneumatic actuator, a linear actuator, and/or any combination thereof. The top drive 100 is pivotally coupled to the linking member 114 at a pivot connection 124. The electric motors 104 and 106 include right-angle drives 104*a* and 106*a*, respectively.

Figure 12:
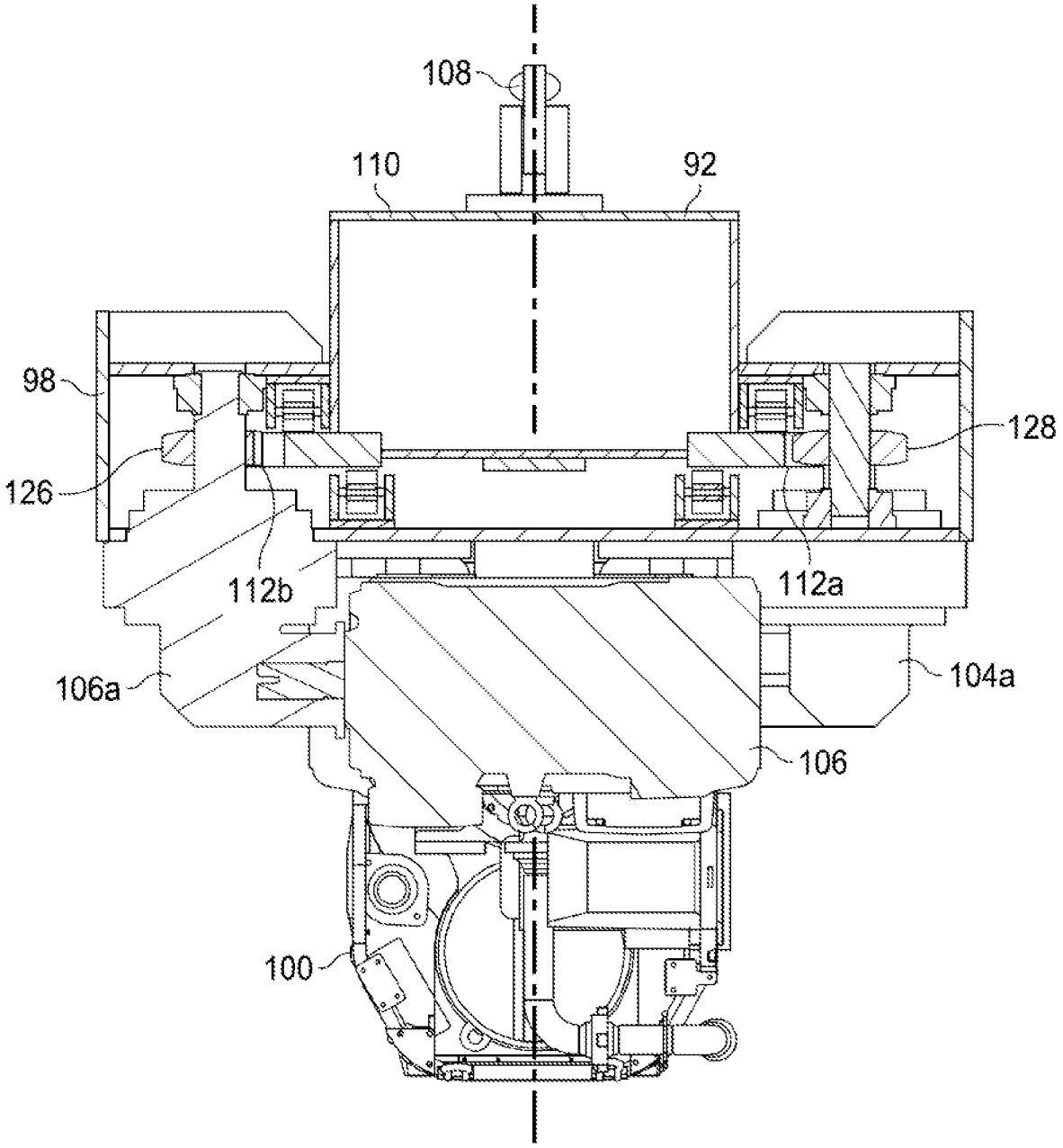
FIG. 12 is a section view taken along line 12-12 of FIG. 10 according to one or more aspects of the present disclosure.

Referring to FIG. 12, illustrated is a section view taken along line 12-12 of FIG. 10. A pinion 126 is operably coupled to the electric motor 106. Although not shown, a pinion that is identical to the pinion 126 is operably coupled to the electric motor 104 in a manner identical to the manner by which the pinion 126 is operably coupled to the electric motor 106. A pinion 128 is coupled to the carriage 98 and engages the rack 112*a*. Unlike the pinion 126, the pinion 128 is not operably coupled to an electric motor and thus does not rotate to cause the carriage 98 to move relative to the tower 92; instead, the pinion 128 rotates in response to movement of the carriage 98 relative to the tower 92. A pinion 130 (shown in hidden lines in FIG. 9) is coupled to the carriage 98 and engages the rack 112*b*. Unlike the pinion 126, the pinion 130 is not operably coupled to an electric motor and thus does not rotate to cause the carriage 98 to move relative to the tower 92; instead, the pinion 130 rotates in response to movement of the carriage 98 relative to the tower 92.

In operation, with continuing reference to FIGS. 8-12, in an exemplary embodiment, the base 90 is positioned adjacent a rig substructure (not shown). The portion 92*a* initially extends parallel to the base 90 in, for example, a horizontal arrangement. The portion 92*b* of the tower 92 initially is in a pivot position at which the portion 92*b* is folded back over onto the portion 92*a* of the tower 92. The portion 92*b* is pivoted at the pivot connection 96 in a clockwise direction as viewed in FIG. 11, and a counterclockwise direction as viewed in FIG. 8 to extend, such as to its full length. The portion 92*b* continues to so pivot until the portion 92*b* is at the pivot position shown in FIGS. 8-12, at which position the portions 92*a* and 92*b* are flush and extend longitudinally along the axis 97, and the carriage 98 and thus the top drive 100 are movable along each of the portions 92*a* and 92*b*. The telescoping support member 108 is actuated, causing the tower 92, and thus the carriage 98 and the top drive 100, to pivot at the pivot connection 94, in a clockwise direction as viewed in FIG. 8.

In an exemplary embodiment, during operation, the electric motor 106 causes the pinion 126 to rotate and engage the teeth of the rack 112*b*. Likewise, the electric motor 104 causes the pinion operably coupled thereto (which is identical to the pinion 126) to rotate and engage the teeth of the rack 112*a*. As a result, the carriage 98 and thus the top drive 100 move up or down, along the axis 97 and relative to the tower 92 as necessary or desired.

During operation, in several exemplary embodiments, before, during or after the top drive 100 is at a necessary or desired position along the axis 97, the actuators 122*a* and 122*b* may actuate, extending their respective lengths. As a result, the linking member 114 pivots at the pivot connection 116. As viewed in FIG. 11, the linking member 114 pivots in a clockwise direction at the pivot connection 116. The linking member 114 pivots from a pivot position corresponding to respective retracted positions of the actuators 122*a* and 122*b*, to a pivot position corresponding to respective extended positions of the actuators 122*a* and 112*b*. Since the top drive 100 is pivotally coupled to the linking member 114 at the pivot connection 124, the top drive 100 continues to extend longitudinally in a parallel relation to the tower 92 when the linking member 114 pivots. The horizontal spacing between the tower 92 and the top drive 100 increases as a result of the linking member 114 pivoting from a pivot position corresponding to respective retracted positions of the actuators 122*a* and 122*b*, to a pivot position corresponding to respective extended positions of the actuators 122*a* and 112*b*.

During operation, in several exemplary embodiments, after the linking member 114 has pivoted to a pivot position corresponding to the respective extended positions of the actuators 112*a* and 112*b*, the actuators 112*a* and 112*b* may be actuated to their respective retracted positions. As a result, the linking member 114 pivots in a counterclockwise direction, as viewed in FIG. 11. Since the top drive 100 is pivotally coupled to the linking member 114 at the pivot connection 124, the top drive 100 continues to extend longitudinally in a parallel relation to the tower 92 when the linking member 114 pivots. The horizontal spacing between the tower 92 and the top drive 100 decreases as a result of the retraction of the actuators 112*a* and 112*b* and thus the pivoting of each of the linking member 114 and the top drive 100.

In operation, in an exemplary embodiment, the apparatus 88 is employed to assemble a string of tubular members, such as drill pipe or casing as part of oil and gas exploration and production operations, in a manner similar to the above-described manner in which the apparatus 10 is employed to assemble a string of tubular members. In several exemplary embodiments, during operation, after the apparatus 88 has been placed in the configuration shown in FIGS. 8-12 by pivoting the portion 92*b*, and pivoting the tower 92, aspects of the operation of the apparatus 88 are substantially similar to corresponding aspects of the above-described operation of the apparatus 10. Therefore, the operation of the embodiment of the apparatus 88 illustrated in FIGS. 8-12 will not be described in further detail.

Figure 13:
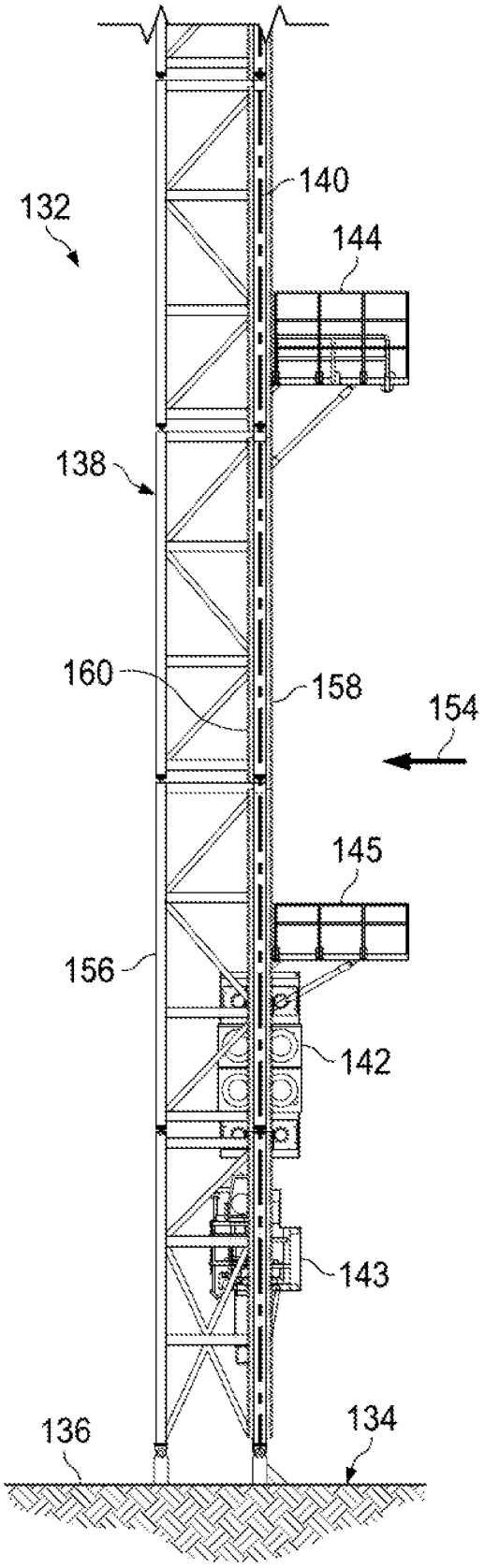
FIG. 13 is a right side elevational view of an apparatus according to one or more aspects of the present disclosure.
Figure 14:
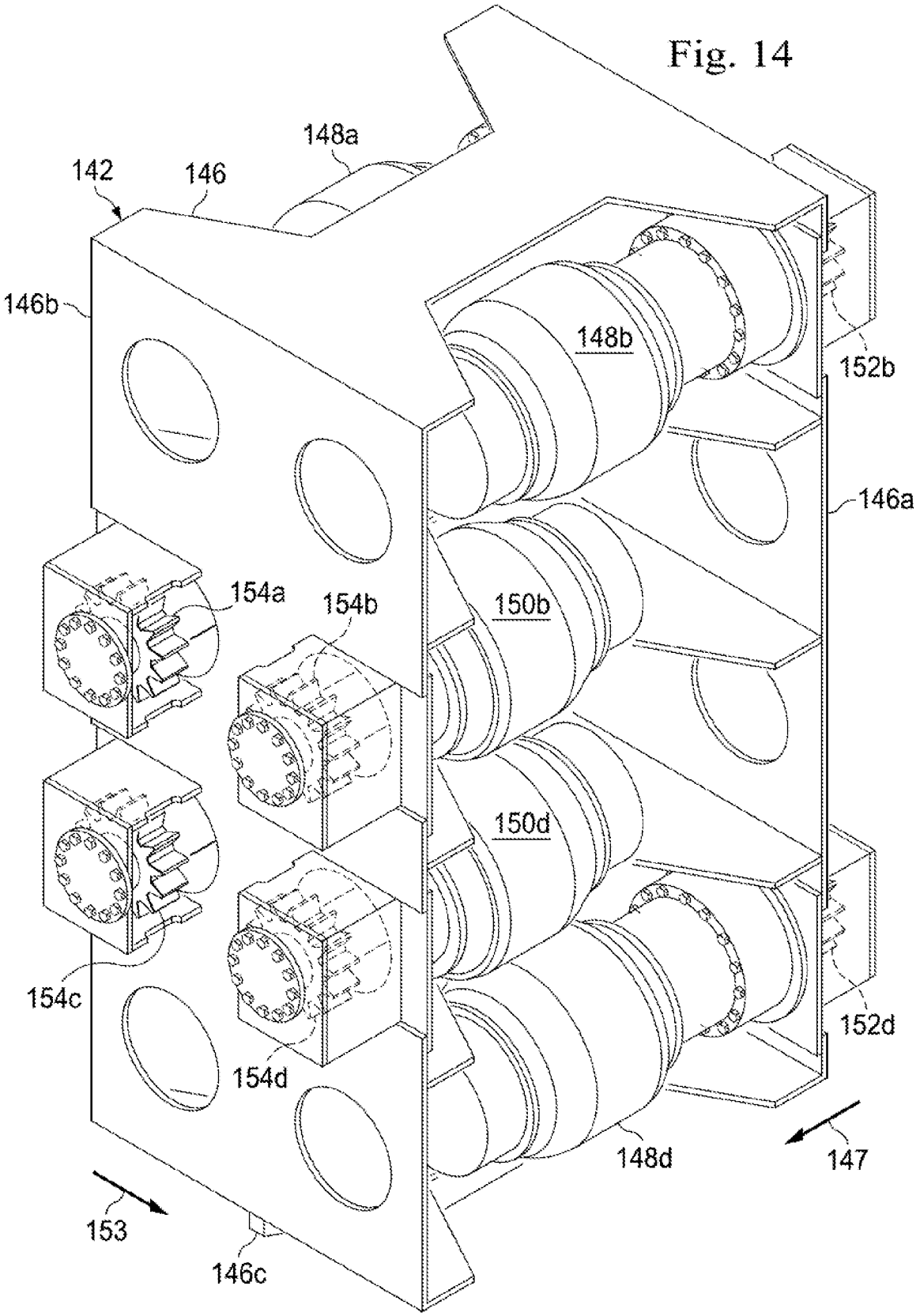
FIG. 14 is a perspective view of a drilling carriage of the apparatus of FIG. 13 according to one or more aspects of the present disclosure.
Figure 15:
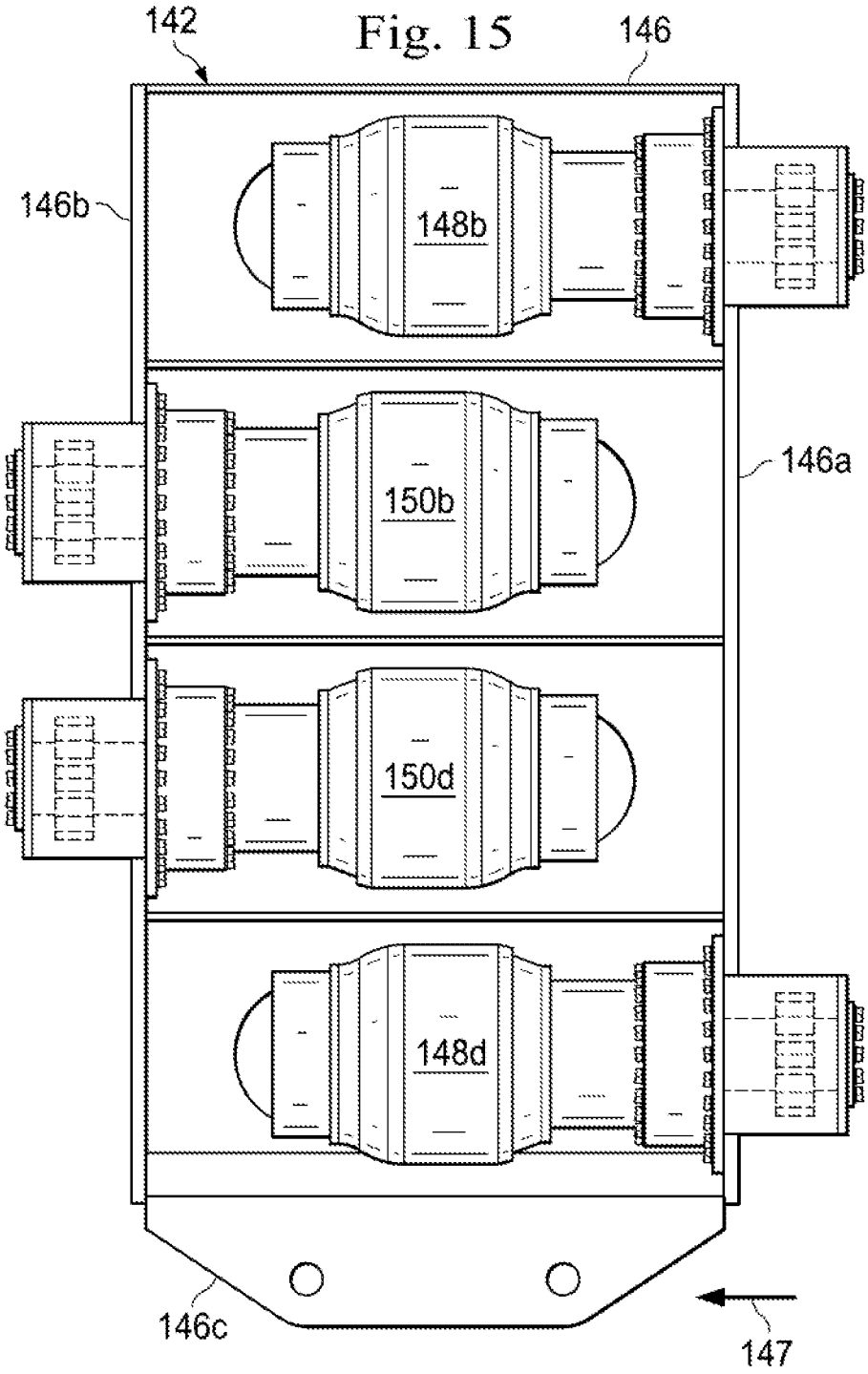
FIGS. 15-18 are front elevational, left side elevational, right side elevational, and top plan views, respectively, of the drilling carriage of FIG. 14 according to one or more aspects of the present disclosure.
Figure 16:
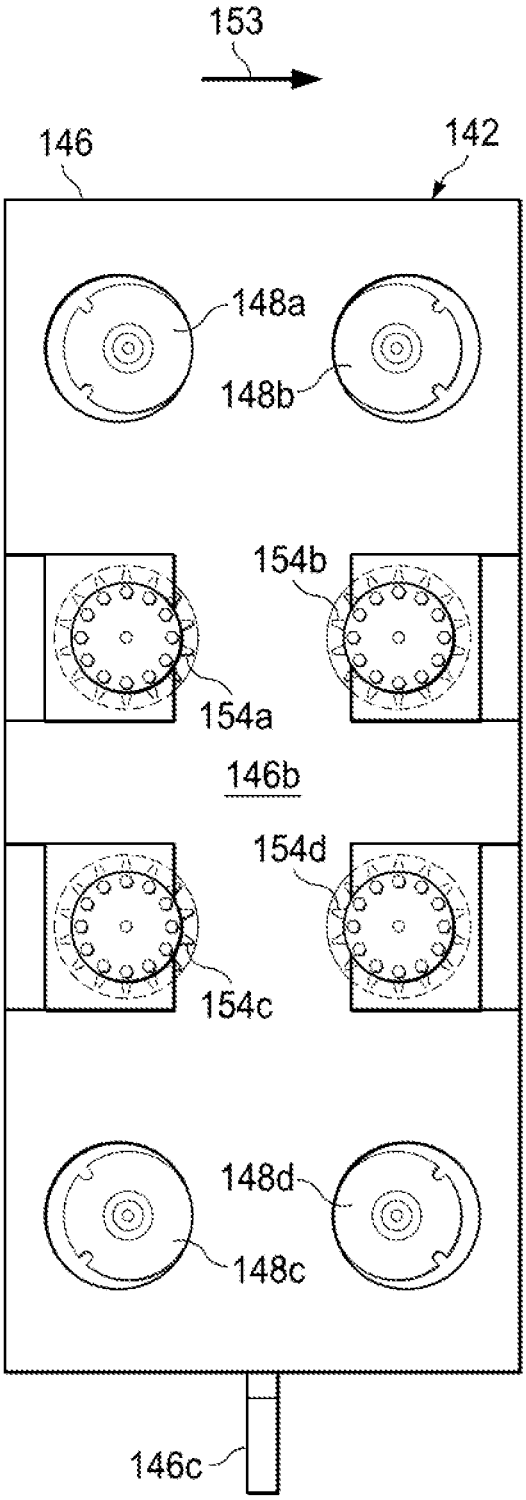
Figure 17:
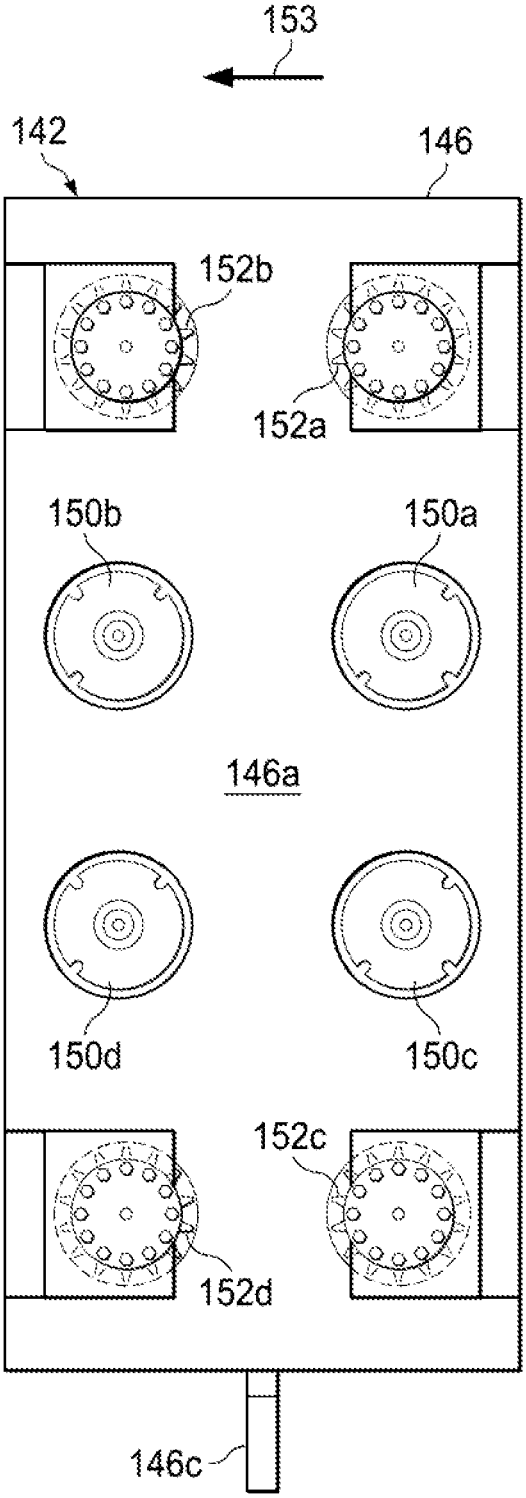
Figure 18:
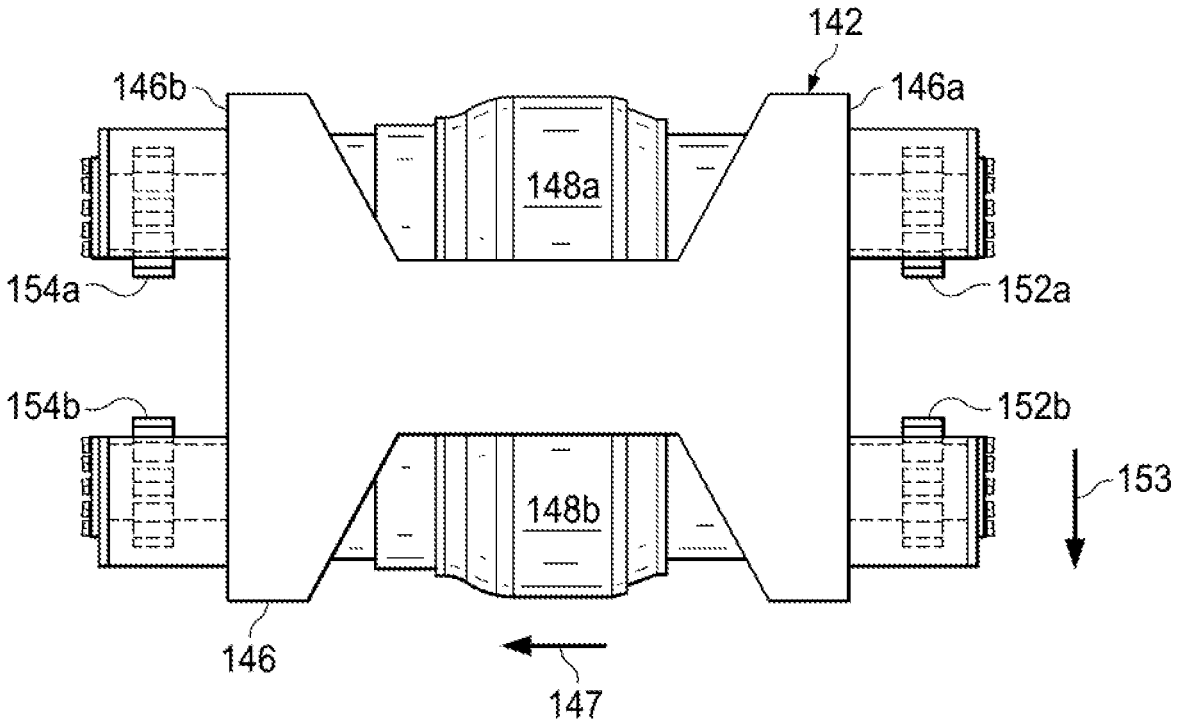

Referring to FIG. 13, illustrated is a right side elevational view of an apparatus 132. The apparatus 132 may be, include, or be part of, a land-based drilling rig. In several exemplary embodiments, instead of a land-based drilling rig, the apparatus 132 may be, include, or be part of, any type of drilling rig, such as a jack-up rig, a semi-submersible rig, a drill ship, a coil tubing rig, a platform rig, a slant rig, or a casing drilling rig, among others. The apparatus 132 includes a platform 134, which includes a rig floor 136 that is positioned adjacent or above the wellbore 16 (not shown in FIG. 13). In several exemplary embodiments, the platform 134 may be, include, or be a part of, one or more of several types of platforms. A tower or drilling mast 138 is coupled to the platform 134, and extends longitudinally along an axis 140. In one embodiment, the drilling mast 138 is releasably coupled. In several exemplary embodiments, the drilling mast 138 may be characterized as a conventional drilling mast.

A drilling carriage 142 is movably coupled to the drilling mast 138. A top drive 143 is coupled to the drilling carriage 142. The top drive 143 extends longitudinally in a parallel relation to the drilling mast 138. As will be described in further detail below, the drilling carriage 142 and the top drive 143 coupled thereto are movable along the axis 140, relative to the drilling mast 138. In several exemplary embodiments, the apparatus 132 does not include the top drive 143; instead, the apparatus 132 may be, include, or be a part of, another type of drilling rig such as, for example, a rotary-swivel rig or a power-swivel rig. A platform, or racking board 144, is coupled to the drilling mast 138 at a vertical position above the rig floor 136. A platform, or belly board 145, is coupled to the drilling mast 138 at a vertical position between the rig floor 136 and the racking board 144.

Referring to FIGS. 14-18, illustrated are respective perspective, front elevational, left side elevational, right side elevational, and top plan views of the drilling carriage 142. A body structure 146 includes side portions 146*a* and 146*b*, which are spaced in a parallel relation. The side portion 146*b* is spaced from the side portion 146*a* in a direction 147 that is perpendicular to the longitudinal extension of the drilling mast 138. A lower portion 146*c* is coupled to the top drive 143 (not shown in FIGS. 14-18). Electric motors 148*a*, 148*b*, 148*c* and 148*d* are coupled to the side portion 146*a*. Similarly, electric motors 150*a*, 150*b*, 150*c* and 150*d* are coupled to the side portion 146*b*. The electric motors 148*a* and 148*b* are vertically aligned along the longitudinal extension of the drilling mast 138 (or the axis 140). The electric motors 148*c* and 148*d* are vertically aligned along the longitudinal extension of the drilling mast 138. The electric motors 150*a* and 150*b* are vertically aligned along the longitudinal extension of the drilling mast 138. The electric motors 150*c* and 150*d* are vertically aligned along the longitudinal extension of the drilling mast 138. Each pair of the electric motors 148*a* and 148*b*, 148*c* and 148*d*, 150*a* and 150*b*, and 150*c* and 150*d*, is vertically spaced from the other pairs along the longitudinal extension of the drilling mast 138 (or the axis 140).

In an exemplary embodiment, each of the electric motors 148*a*-148*d* and 150*a*-150*d* is an AC motor and is controlled by either a single variable-frequency drive (VFD) or multiple VFDs, which is/are synchronized and programmed to work simultaneously with the other motors to provide uniform motion and torque. In an exemplary embodiment, one or more of the electric motors 148*a*-148*d* and 150*a*-150*d* are controlled by a single VFD. In an exemplary embodiment, one or more the electric motors 148*a*-148*d* and 150*a*-150*d* are controlled by multiple VFDs. In an exemplary embodiment, each of the electric motors 148*a*-148*d* and 150*a*-150*d* is an AC motor and provides primary dynamic braking. In an exemplary embodiment, each of the electric motors 148*a*-148*d* and 150*a*-150*d* includes a gearbox and a brake therein or thereat. In an exemplary embodiment, each of the electric motors 148*a*-148*d* and 150*a*-150*d* includes an encoder incorporated on the motor shaft to provide more precise VFD control.

Pinions 152*a* and 152*b* are operably coupled to the electric motors 148*a* and 148*b*, respectively. The pinion 152*b* is spaced from the pinion 152*a* in a direction 153, which is perpendicular to each of the direction 147 and the longitudinal extension of the drilling mast 138. Pinions 152*c* and 152*d* are operably coupled to the electric motors 148*c* and 148*d*, respectively. The pinion 152*d* is spaced from the pinion 152*c* in the direction 153. Similarly, pinions 154*a* and 154*b* are operably coupled to the electric motors 150*a* and 150*b*, respectively. The pinion 154*b* is spaced from the pinion 154*a* in the direction 153. Pinions 154*c* and 154*d* are operably coupled to the electric motors 150*c* and 150*d*, respectively. The pinion 154*d* is spaced from the pinion 154*c* in the direction 153. The pinions 154*a* and 154*b* are spaced from the pinions 152*a* and 152*b*, respectively, in the direction 147. Likewise, the pinions 154*c* and 154*d* are spaced from the pinions 152*c* and 152*d*, respectively, in the direction 147.

Figure 19:
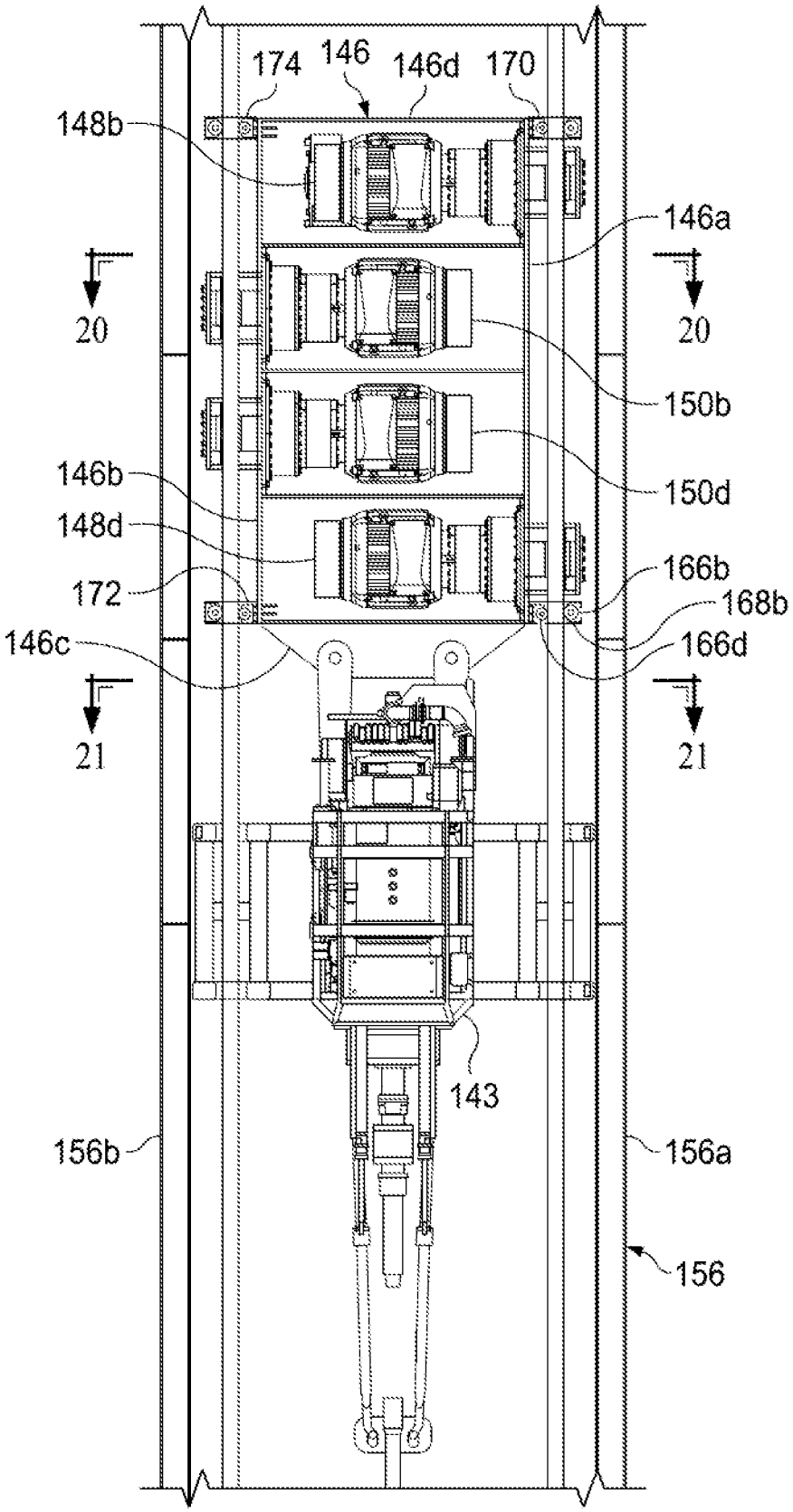
FIG. 19 is a front elevational view of a portion of the apparatus of FIG. 13 according to one or more aspects of the present disclosure.
Figure 20:
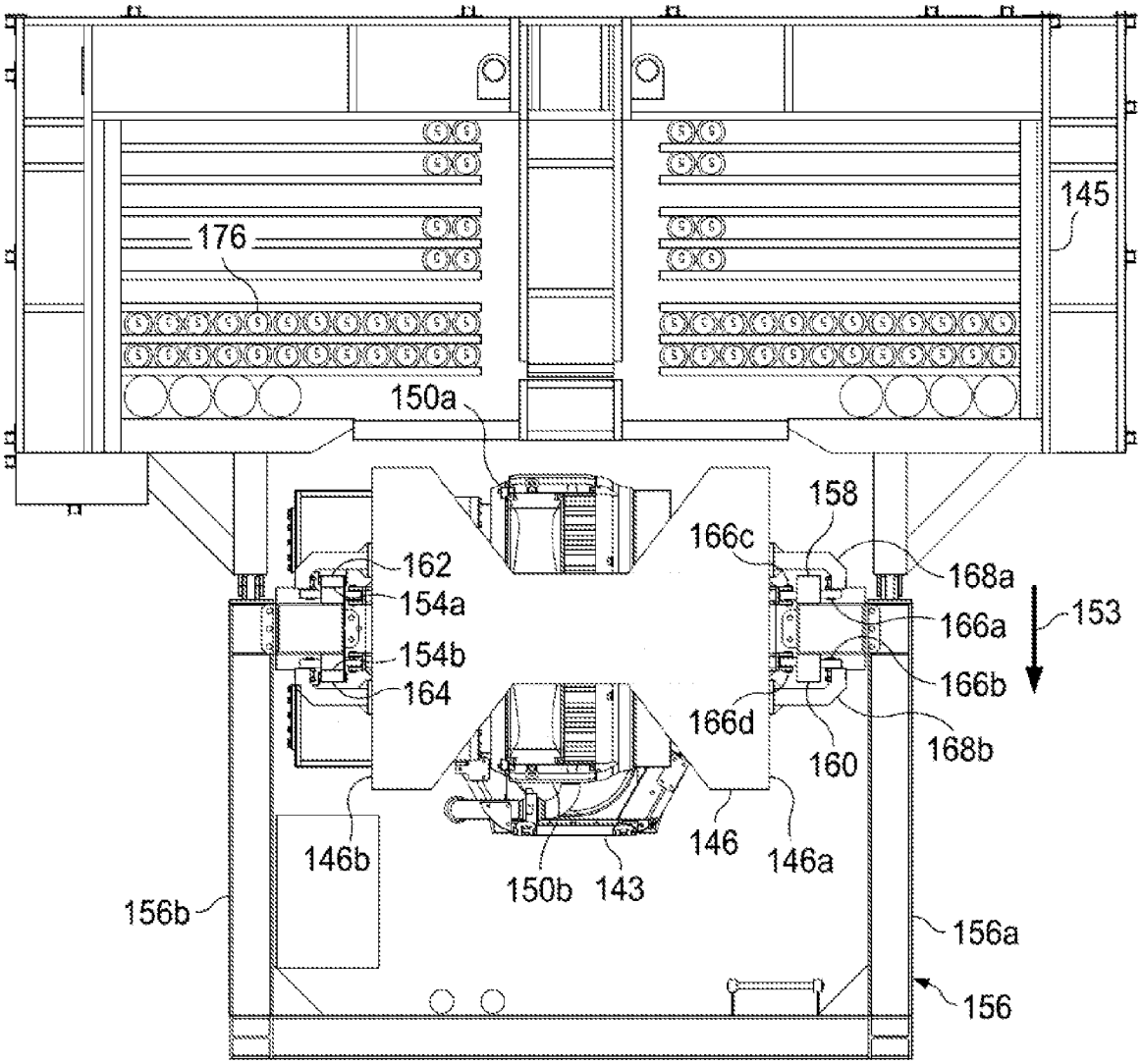
FIG. 20 is a sectional view taken along line 20-20 of FIG. 19 according to one or more aspects of the present disclosure.
Figure 21:
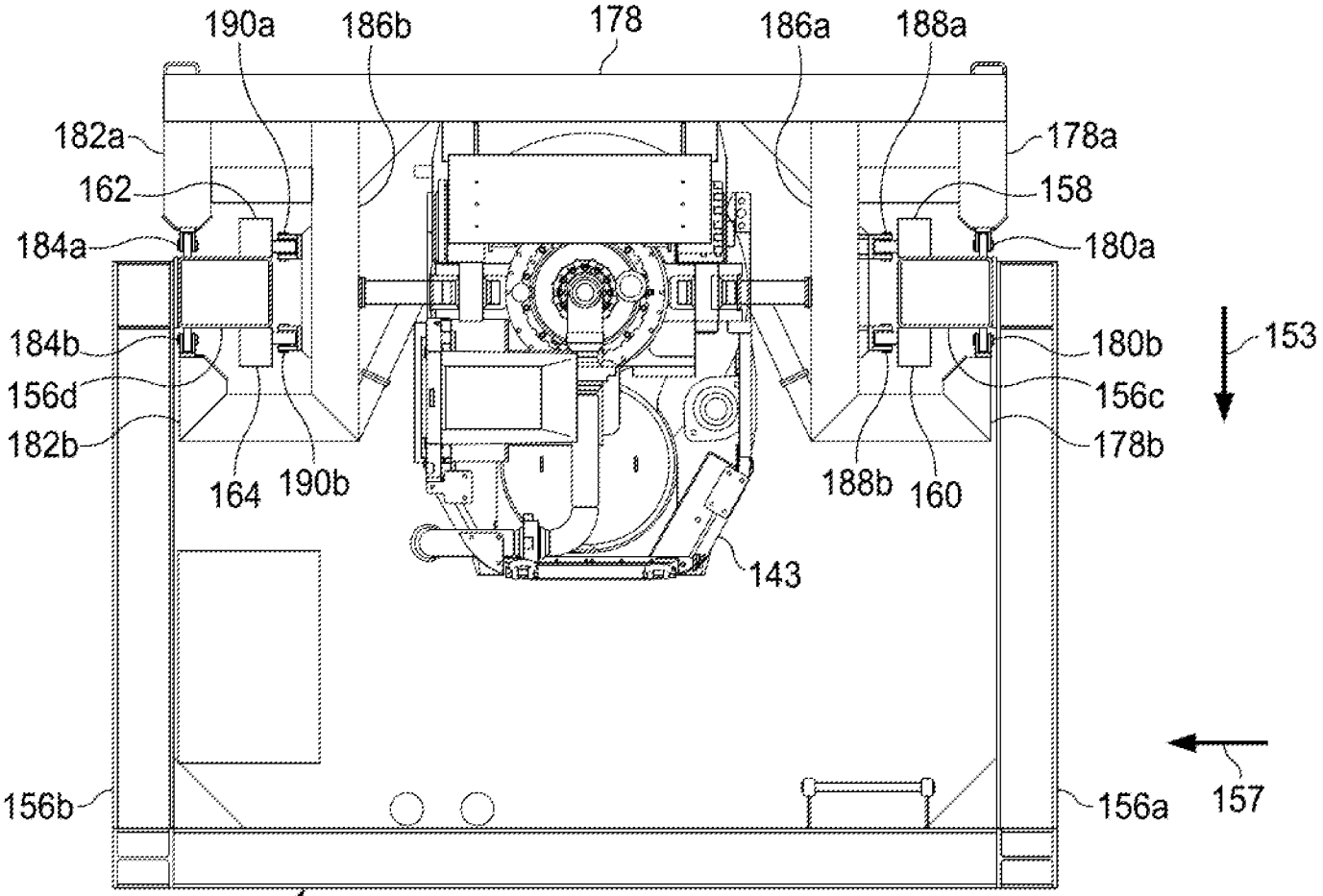
FIG. 21 is a sectional view taken along line 21-21 of FIG. 19 according to one or more aspects of the present disclosure.

Referring to FIGS. 19, 20 and 21, illustrated are a front elevational view, a sectional view taken along line 20-20 of FIG. 19, and a sectional view taken along line 21-21 of FIG. 19, respectively, of the apparatus 132. The drilling mast 138 includes a frame 156, which includes side portions 156*a* and 156*b*, which are spaced in a parallel relation. The side portion 156*b* is spaced from the side portion 156*a* in the direction 147.

Racks 158 and 160 are coupled to the frame 156 at the side portion 156*a* thereof. In an exemplary embodiment, the racks 158 and 160 are coupled to the frame 156 by being integrally formed with the frame 156. The rack 160 is spaced from the rack 158 in the direction 153. The rack 160 faces away from the rack 158. The pinion 148*b* is spaced from the pinion 148*a* in the direction 153 so that the pinions 148*a* and 148*b* engage the racks 158 and 160, respectively. Likewise, the pinion 148*d* is spaced from the pinion 148*c* in the direction 153 so that the pinions 148*c* and 148*d* engage the racks 158 and 160, respectively.

Similarly, racks 162 and 164 are coupled to the frame 156 at the side portion 156*b* thereof. In an exemplary embodiment, the racks 162 and 164 are coupled to the frame 156 by being integrally formed with the frame 156. The rack 164 is spaced from the rack 162 in the direction 153. The rack 164 faces away from the rack 162. The racks 162 and 164 are aligned with the racks 158 and 160, respectively, in the direction 153. The pinion 150*b* is spaced from the pinion 150*a* in the direction 153 so that the pinions 150*a* and 150*b* engage the racks 162 and 164, respectively. Likewise, the pinion 150*d* is spaced from the pinion 150*c* in the direction 153 so that the pinions 150*c* and 150*d* engage the racks 162 and 164, respectively.

A plurality of rollers 166, including rollers 166*a*, 166*b*, 166*c* and 166*d*, are coupled to the side portion 146*a* of the body structure 146 at a location proximate the lower portion 146*c*. The rollers 166*a* and 166*b* are coupled to arms 168*a* and 168*b*, which extend from the side portion 146*a* of the body structure 146. The rollers 166*a* and 166*b* engage the respective outer sides of the racks 158 and 160, respectively. The rollers 166*c* and 166*d* are coupled to the side portion 146*a* and engage the respective inner sides of the racks 158 and 160, respectively. Under conditions to be described below, the plurality of rollers 166 facilitate in guiding the carriage 142 as it moves up and down the drilling mast 138, and facilitate in maintaining the respective engagements between the pinions 152*a* and 152*c* and the rack 158, and the respective engagements between the pinions 152*b* and 152*d* and the rack 160.

As shown in FIG. 19, a plurality of rollers 170 is coupled to the side portion 146*a* at a location proximate a top portion 146*d* of the body structure 146. Pluralities of rollers 172 and 174 are coupled to the side portion 146*b* at respective locations proximate the lower portion 146*c* and the top portion 146*d*. Each of the pluralities of rollers 170, 172 and 174 is substantially identical to the plurality of rollers 166 and therefore the rollers 170, 172 and 174 will not be described in further detail.

As shown in FIG. 20, the apparatus 132 is capable of racking pipe, and thus supports tubular members (or tubulars) 176, such as drill pipe or casing as part of oil and gas exploration and production operations. In several exemplary embodiments, the belly board 145 and/or the racking board 144 may be used to support the tubular members 176. In several exemplary embodiments, the tubular members 176 may be Range II triple tubulars and thus may be about 93 feet long. In several exemplary embodiments, the tubular members 176 may be Range III double tubulars and thus may be about 92 feet long. In several exemplary embodiments, the tubular members 176 may be Range II tubulars and thus may be about 31 feet long. In several exemplary embodiments, the tubular members 176 may be Range III tubulars and thus may be about 46 feet long.

As shown in FIG. 21, the top drive 143 is coupled to a body structure 178, which is movable with the top drive 143 and the drilling carriage 142. The body structure 178 includes arms 178*a* and 178*b*, to which rollers 180*a* and 180*b* are coupled, respectively. The rollers 180*a* and 180*b* respectively engage opposing sides of a vertically-extending member 156*c* of the frame 156 of the drilling mast 138. The body structure 178 further includes arms 182*a* and 182*b*, to which rollers 184*a* and 184*b* are coupled, respectively. The rollers 184*a* and 184*b* respectively engage opposing sides of a vertically-extending member 156*d* of the frame 156 of the drilling mast 138. An arm 186*a* is coupled between the top drive 143 and the arms 178*a* and 178*b*, and an arm 186*b* is coupled between the top drive 143 and the arms 182*a* and 182*b*. Rollers 188*a* and 188*b* are coupled to the arm 186*a*, and engage the respective inner sides of the racks 158 and 160. Rollers 190*a* and 190*b* are coupled to the arm 186*b*, and engage the respective inner sides of the racks 162 and 164. Under conditions to be described below, the rollers 180*a*, 180*b*, 184*a*, 184*b*, 188*a*, 188*b*, 190*a* and 190*b* facilitate in guiding the top drive 143 as it moves up and down the drilling mast 138, and facilitate in maintaining the respective engagements between the pinions 152*a* and 152*c* and the rack 158, the respective engagements between the pinions 152*b* and 152*d* and the rack 160, the respective engagements between the pinions 154*a* and 154*c* and the rack 162, and the respective engagements between the pinions 154*b* and 154*d* and the rack 164.

In operation, in an exemplary embodiment with continuing reference to FIGS. 13-21, the apparatus 132 is employed to assemble a string of the tubular members 176. More particularly, at least one of the tubular members 176 is temporarily coupled to the top drive 143, which operates to couple (or separate) that tubular member 176 to (or from) another of the tubular members 176 which already extends within the wellbore 16 or is vertically positioned between the wellbore 16 and the tubular member 176 coupled to the top drive 143. For all embodiments described herein, the operations disclosed herein may be conducted in reverse to trip pipe or casing out of a wellbore and disassemble tubular members or pairs of tubular members from the string of tubular members. As noted above, in several exemplary embodiments, the tubular members 176 may be Range II tubulars, and/or the tubular members 176 may be Range III tubulars.

The electric motors 148*a* and 148*c* cause the respective pinions 152*a* and 152*c* to rotate and engage teeth of the rack 158. The electric motors 148*b* and 148*d* cause the respective pinions 152*b* and 152*d* to rotate and engage teeth of the rack 160. The electric motors 150*a* and 150*c* cause the respective pinions 154*a* and 154*c* to rotate and engage teeth of the rack 162. The electric motors 150*b* and 150*d* cause the respective pinions 154*b* and 154*d* to rotate and engage teeth of the rack 164. As a result, the drilling carriage 142 and thus the top drive 143 move upward and/or downward, along the axis 140 and relative to the drilling mast 138 as necessary, so that the top drive 143 is at a position along the axis 140 at which one of the tubular members 176 can be coupled to the top drive 143.

The electric motors 148*a*-148*d* and 150*a*-150*d* move the top drive 143 downward along the axis 140 and relative to the drilling mast 138, lowering the tubular member 176 coupled to the top drive 143. Before, during or after this lowering, the top drive 143 operates to couple the tubular member 176 coupled to the top drive 143 to another of the tubular members 176 either extending in the wellbore 16 or being vertically positioned between the wellbore 16 and the tubular member 176 coupled to the top drive 143; this other tubular member 176 may be part of a string of drill pipe or casing.

In several exemplary embodiment, during the upward and/or downward movement of the top drive 143, the plurality of rollers 166 facilitate in guiding the carriage 142 as it moves up and down the drilling mast 138, and facilitate in maintaining the respective engagements between the pinions 152*a* and 152*c* and the rack 158, and the respective engagements between the pinions 152*b* and 152*d* and the rack 160. Similarly, in several exemplary embodiments, the rollers 180*a*, 180*b*, 184*a*, 184*b*, 188*a*, 188*b*, 190*a* and 190*b* facilitate in guiding the top drive 143 as it moves up and down the drilling mast 138, and facilitate in maintaining the respective engagements between the pinions 152*a* and 152*c* and the rack 158, the respective engagements between the pinions 152*b* and 152*d* and the rack 160, the respective engagements between the pinions 154*a* and 154*c* and the rack 162, and the respective engagements between the pinions 154*b* and 154*d* and the rack 164.

In several exemplary embodiments, the arrangement of the rack 158 and the rack 160 facing away from the rack 158 at the side portion 156*a* of the frame 156 reduces the degree to which the racks 158 and 160 undergo bending and/or torsional loading, thereby reducing the risk of unacceptable stress and strain levels in the frame 156 and the racks 158 and 160. Likewise, in several exemplary embodiments, the arrangement of the rack 162 and the rack 164 facing away from the rack 162 at the side portion 156*b* of the frame 156 reduces the degree to which the racks 162 and 164 undergo bending and/or torsional loading, thereby reducing the risk of unacceptable stress and strain levels in the frame 156 and the racks 162 and 164.

In several exemplary embodiments, the apparatus 132 is not limited to tubular singles using a box (or frame) style structure for a drilling mast. Instead, in several exemplary embodiments, the apparatus 132 can be used with a conventional style drilling mast capable of handling tubular Range II triples or tubular Range III doubles and capable of racking pipe. In several exemplary embodiments, the apparatus 132 is capable of racking pipe in the drilling mast 138, increasing drilling speed, and providing off-line stand building, among other capabilities.

In several exemplary embodiments, the apparatus 132 or components thereof may be used in a wide variety of drilling applications including, but not limited to, horizontal drilling applications, thermal drilling applications, etc.

Figure 22:
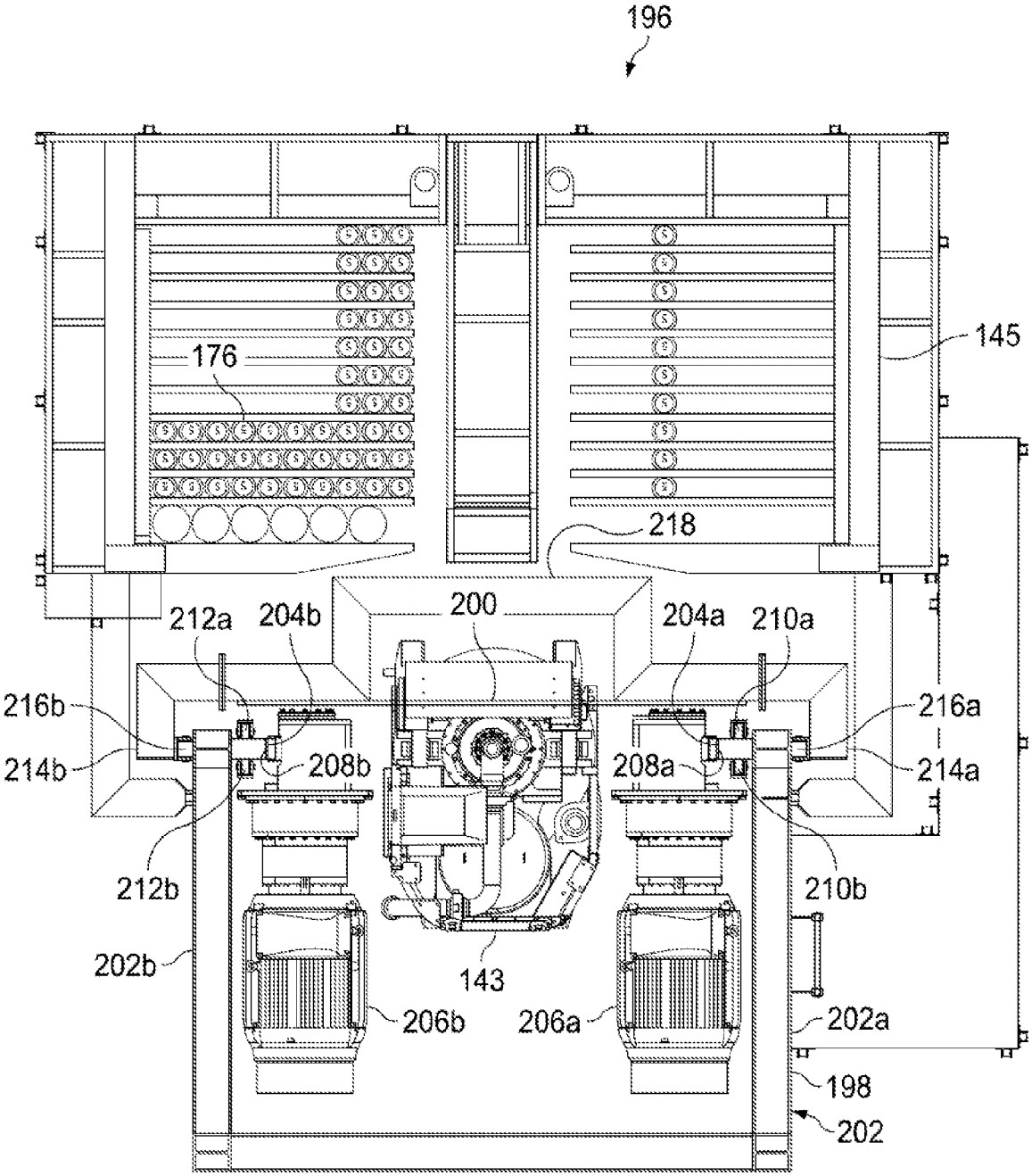
FIG. 22 is a top plan view of an apparatus according to one or more aspects of the present disclosure.

Referring to FIG. 22, illustrated is a top plan view of an apparatus 196. The apparatus 196 may be, include, or be part of, a land-based drilling rig. In several exemplary embodiments, instead of a land-based drilling rig, the apparatus 196 may be, include, or be part of, any type of drilling rig, such as a jack-up rig, a semi-submersible rig, a drill ship, a coil tubing rig, a platform rig, a slant rig, or a casing drilling rig, among others. In several exemplary embodiments, the apparatus 196 includes several components of the apparatus 132, which components are given the same reference numerals. The apparatus 196 includes the platform 134 (not shown), to which a tower or drilling mast 198 is coupled. A drilling carriage 200 is movably coupled to the drilling mast 198. The top drive 143 is coupled to the drilling carriage 200. The top drive 143 extends longitudinally in a parallel relation to the drilling mast 198. In several exemplary embodiments, the apparatus 196 does not include the top drive 143; instead, the apparatus 196 may be, include, or be a part of, another type of drilling rig such as, for example, a rotary-swivel rig or a power-swivel rig. The racking board 144 (not shown) is coupled to the drilling mast 198 at a vertical position above the platform 134. The belly board 145 is coupled to the drilling mast 198 at a vertical position between the platform 134 and the racking board 144. In a manner similar to the apparatus 132, the apparatus 196 is capable of racking pipe, and thus supports the tubular members 176. In several exemplary embodiments, the belly board 145 and/or the racking board 144 may be used to support the tubular members 176. In several exemplary embodiments, the tubular members 176 may be Range II triple tubulars and thus may be about 93 feet long. In several exemplary embodiments, the tubular members 176 may be Range III double tubulars and thus may be about 92 feet long. In several exemplary embodiments, the tubular members 176 may be Range II tubulars and thus may be about 31 feet long. In several exemplary embodiments, the tubular members 176 may be Range III tubulars and thus may be about 46 feet long.

As shown in FIG. 22, the drilling mast 198 includes a frame 202 and racks 204*a* and 204*b* coupled to opposing side portions thereof. In another embodiment (not shown), the racks 204*a* and 204*b* are coupled to the frame 202 by being integrally formed with the frame 202. The racks 204*a* and 204*b* are spaced in a parallel relation and face towards each other. Electric motors 206*a* and 206*b* are coupled to the drilling carriage 200 and thus also to the top drive 143. Pinions 208*a* and 208*b* are operably coupled to the electric motors 206*a* and 206*b*, respectively. The pinions 208*a* and 208*b* engage the racks 204*a* and 204*b*, respectively. Inside rollers 210*a* and 210*b* are coupled to the drilling carriage 200 and engage opposing sides of the rack 204*a*. Inside rollers 212*a* and 212*b* are coupled to the drilling carriage 200 and engage opposing sides of the rack 204*b*. Opposing arms 214*a* and 214*b* are coupled to the drilling carriage 200. Outside rollers 216*a* and 216*b* are coupled to the arms 214*a* and 214*b*, respectively, and engage opposing side portions 202*a* and 202*b*, respectively, of the frame 202 of the drilling mast 198. A structural member 218 extends between the arms 214*a* and 214*b*.

In several exemplary embodiments, the apparatus 196 includes additional sets of electric motors, pinions, inside rollers, opposing arms and outside rollers that are substantially identical to the electric motors 206*a* and 206*b*, the pinions 208*a* and 208*b*, the inside rollers 210, 210*b*, 212*a* and 212*b*, the opposing arms 214*a* and 214*b*, and the outside rollers 216*a* and 216*b*, respectively. In an exemplary embodiment, the apparatus 196 includes at least four such additional sets, and these additional sets may be vertically spaced along the drilling carriage 200. In several exemplary embodiments, the apparatus 196 includes additional structural members that are substantially identical to the structural member 218. In an exemplary embodiment, the apparatus 196 includes at least three such additional structural members, and these additional structural members may be vertically spaced along the drilling carriage 200.

In operation, in an exemplary embodiment with continuing reference to FIG. 22, the apparatus 196 is employed to assemble a string of the tubular members 176. More particularly, at least one of the tubular members 176 is temporarily coupled to the top drive 143, which operates to couple (or separate) that tubular member 176 to (or from) another of the tubular members 176 which already extends within the wellbore 16 or is vertically positioned between the wellbore 16 and the tubular member 176 coupled to the top drive 143. For all embodiments described herein, the operations disclosed herein may be conducted in reverse to trip pipe or casing out of a wellbore and disassemble tubular members or pairs of tubular members from the string of tubular members. The electric motors 206*a* and 206*b* cause the respective pinions 208*a* and 208*b* to rotate and engage teeth of the respective racks 204*a* and 204*b*. As a result, the drilling carriage 200 and thus the top drive 143 move upward and/or downward, relative to the drilling mast 196 as necessary, so that the top drive 143 is at a position at which one of the tubular members 176 can be coupled to the top drive 143. The electric motors 206*a* and 206*b* move the top drive 143 downward, relative to the drilling mast 138, lowering the tubular member 176 coupled to the top drive 143. Before, during or after this lowering, the top drive 143 operates to couple the tubular member 176 coupled to the top drive 143 to another of the tubular members 176 either extending in the wellbore 16 or being vertically positioned between the wellbore 16 and the tubular member 176 coupled to the top drive 143; this other tubular member 176 may be part of a string of drill pipe or casing.

In several exemplary embodiment, during the upward and/or downward movement of the top drive 143, the inside rollers 210, 210*b*, 212*a* and 212*b*, and the outside rollers 216*a* and 216*b*, facilitate in guiding the drilling carriage 200 as it moves up and down the drilling mast 198, and facilitate in maintaining the respective engagements between the pinions 208*a* and 208*b* and the racks 204*a* and 204*b*.

Figure 23:
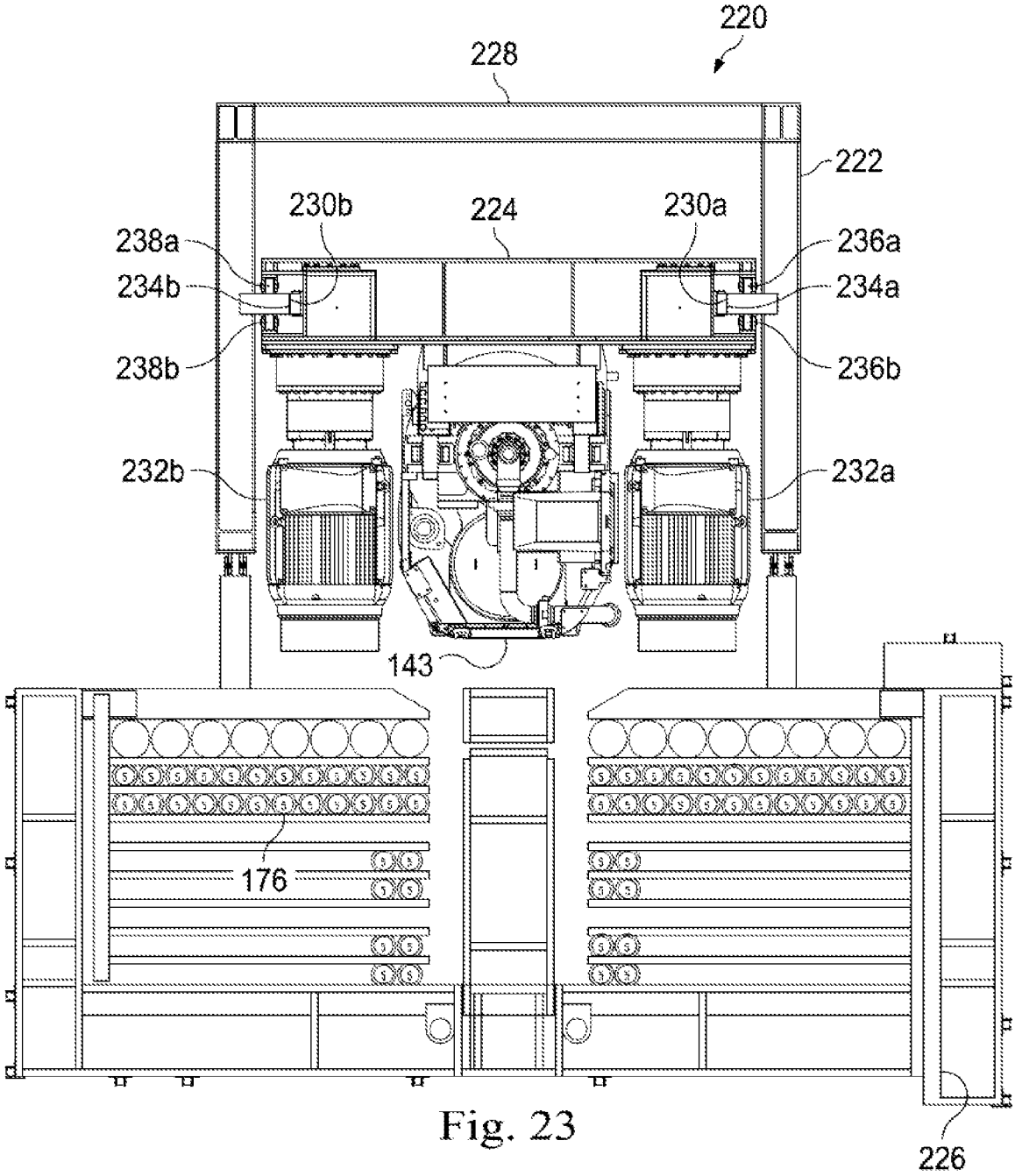
FIG. 23 is a top plan view of an apparatus according to one or more aspects of the present disclosure.

Referring to FIG. 23, illustrated is a top plan view of an apparatus 220. The apparatus 220 may be, include, or be part of, a land-based drilling rig. In several exemplary embodiments, instead of a land-based drilling rig, the apparatus 220 may be, include, or be part of, any type of drilling rig, such as a jack-up rig, a semi-submersible rig, a drill ship, a coil tubing rig, a platform rig, a slant rig, or a casing drilling rig, among others. In several exemplary embodiments, the apparatus 220 includes several components of the apparatus 132, which components are given the same reference numerals. The apparatus 220 includes the platform 134 (not shown), to which a tower or drilling mast 222 is coupled. A drilling carriage 224 is movably coupled to the drilling mast 222. The top drive 143 is coupled to the drilling carriage 224. The top drive 143 extends longitudinally in a parallel relation to the drilling mast 222. In several exemplary embodiments, the apparatus 220 does not include the top drive 143; instead, the apparatus 220 may be, include, or be a part of, another type of drilling rig such as, for example, a rotary-swivel rig or a power-swivel rig. A racking board (not shown) is coupled to the drilling mast 222 at a vertical position above the platform 134, and a belly board 226 is coupled to the drilling mast 222 at a vertical position between the platform 134 and the racking board. In a manner similar to the apparatus 132, the apparatus 220 is capable of racking pipe, and thus supports the tubular members 176. In several exemplary embodiments, the tubular members 176 may be Range II triple tubulars and thus may be about 93 feet long. In several exemplary embodiments, the tubular members 176 may be Range III double tubulars and thus may be about 92 feet long. In several exemplary embodiments, the tubular members 176 may be Range II tubulars and thus may be about 31 feet long. In several exemplary embodiments, the tubular members 176 may be Range III tubulars and thus may be about 46 feet long.

As shown in FIG. 23, the drilling mast 222 includes a frame 228 and racks 230*a* and 230*b* coupled to opposing side portions thereof. In another embodiment (not shown), the racks 230*a* and 230*b* are coupled to the frame 228 by being integrally formed with the frame 228. The racks 230*a* and 230*b* are spaced in a parallel relation and face towards each other. Electric motors 232*a* and 232*b* are coupled to the drilling carriage 224 and thus also to the top drive 143. Pinions 234*a* and 234*b* are operably coupled to the electric motors 232*a* and 232*b*, respectively. The pinions 234*a* and 234*b* engage the racks 230*a* and 230*b*, respectively. Rollers 236*a* and 236*b* are coupled to the drilling carriage 224 and engage opposing sides of the rack 230*a*. Rollers 238*a* and 238*b* are coupled to the drilling carriage 224 and engage opposing sides of the rack 230*b*. In several exemplary embodiments, the apparatus 220 includes additional sets of electric motors, pinions, and rollers that are substantially identical to the electric motors 232*a* and 232*b*, the pinions 234*a* and 234*b*, and the rollers 236*a*, 236*b*, 238*a* and 238*b*, respectively.

In operation, in an exemplary embodiment with continuing reference to FIG. 23, the apparatus 220 is employed to assemble a string of the tubular members 176. More particularly, at least one of the tubular members 176 is temporarily coupled to the top drive 143, which operates to couple (or separate) that tubular member 176 to (or from) another of the tubular members 176 which already extends within the wellbore 16 or is vertically positioned between the wellbore 16 and the tubular member 176 coupled to the top drive 143. For all embodiments described herein, the operations disclosed herein may be conducted in reverse to trip pipe or casing out of a wellbore and disassemble tubular members or pairs of tubular members from the string of tubular members. The electric motors 232*a* and 232*b* cause the respective pinions 234*a* and 234*b* to rotate and engage teeth of the respective racks 230*a* and 230*b*. As a result, the drilling carriage 224 and thus the top drive 143 move upward and/or downward, relative to the drilling mast 222 as necessary, so that the top drive 143 is at a position at which one of the tubular members 176 can be coupled to the top drive 143. The electric motors 232*a* and 232*b* move the top drive 143 downward, relative to the drilling mast 222, lowering the tubular member 176 coupled to the top drive 143. Before, during or after this lowering, the top drive 143 operates to couple the tubular member 176 coupled to the top drive 143 to another of the tubular members 176 either extending in the wellbore 16 or being vertically positioned between the wellbore 16 and the tubular member 176 coupled to the top drive 143; this other tubular member 176 may be part of a string of drill pipe or casing. In several exemplary embodiments, during the upward and/or downward movement of the top drive 143, the rollers 236*a*, 236*b*, 238*a* and 238*b* facilitate in guiding the drilling carriage 224 as it moves up and down the drilling mast 222, and facilitate in maintaining the respective engagements between the pinions 234*a* and 234*b* and the racks 230*a* and 230*b*.

In view of the above and the figures, one of ordinary skill in the art will readily recognize that the present disclosure introduces an apparatus that includes a drilling mast, which includes a longitudinally-extending frame having a first side portion and a second side portion spaced therefrom in a parallel relation and in a first direction that is perpendicular to the longitudinal extension of the frame; a first rack coupled to the frame at the first side portion thereof; and a second rack coupled to the frame at the first side portion thereof; wherein the second rack is spaced from the first rack in a parallel relation and in a second direction that is perpendicular to each of the first direction and the longitudinal extension of the frame; and wherein the second rack faces away from the first rack; and a drilling carriage adapted to move along the drilling mast, the drilling carriage including a body structure; first and second electric motors coupled to the body structure; and first and second pinions operably coupled to the first and the second electric motors, respectively; wherein the second pinion is spaced from the first pinion in the second direction so that the first and second pinions are adapted to engage the first and second racks, respectively. According to one aspect, the drilling mast further includes a third rack coupled to the frame at the second side portion thereof; and a fourth rack coupled to the frame at the second side portion thereof; wherein the fourth rack is spaced from the third rack in a parallel relation and in the second direction; and wherein the fourth rack faces away from the third rack; and wherein the drilling carriage further includes third and fourth electric motors coupled to the body structure; and third and fourth pinions operably coupled to the third and fourth electric motors, respectively; wherein the third and fourth pinions are spaced from the first and second pinions, respectively, in the first direction; and wherein the fourth pinion is spaced from the third pinion in the second direction so that the third and fourth pinions are adapted to engage the third and fourth racks, respectively. According to another aspect, the first and second racks are aligned with the third and fourth racks, respectively, in the second direction; wherein the first and second electric motors are aligned along the longitudinal extension of the drilling mast; wherein the third and fourth electric motors are aligned along the longitudinal extension of the drilling mast; and wherein the third and fourth electric motors are spaced from the first and second electric motors along the longitudinal extension of the drilling mast.

The present disclosure also introduces a drilling carriage adapted to move along a longitudinally-extending drilling mast, the drilling mast including a first rack and a second rack spaced therefrom in a parallel relation and in a first direction that is perpendicular to the longitudinal extension of the drilling mast, the second rack facing away from the first rack, the drilling carriage including a body structure; first and second electric motors coupled to the body structure; and first and second pinions operably coupled to the first and the second electric motors, respectively; wherein the second pinion is spaced from the first pinion in the first direction so that the first and second pinions are adapted to engage the first and second racks, respectively. According to one aspect, the drilling carriage includes third and fourth electric motors coupled to the body structure; and third and fourth pinions operably coupled to the third and fourth electric motors, respectively; wherein the third and fourth pinions are spaced from the first and second pinions, respectively, in a second direction that is perpendicular to each of the longitudinal extension of the drilling mast and the first direction; and wherein the fourth pinion is spaced from the third pinion in the first direction so that the third pinion is adapted to engage a third rack of the drilling mast and the fourth pinion is adapted to engage a fourth rack of the drilling mast that faces away from the third rack. According to another aspect, the first and second electric motors are aligned along the longitudinal extension of the drilling mast; wherein the third and fourth electric motors are aligned along the longitudinal extension of the drilling mast; and wherein the third and fourth electric motors are spaced from the first and second electric motors along the longitudinal extension of the drilling mast. According to yet another aspect, the second electric motor is spaced from the first electric motor along the longitudinal extension of the drilling mast. According to still yet another aspect, the fourth electric motor is spaced from the third electric motor along the longitudinal extension of the drilling mast.

The present disclosure also introduces a drilling mast along which a drilling carriage is adapted to move, the drilling mast including a longitudinally-extending frame having a first side portion and a second side portion spaced therefrom in a parallel relation and in a first direction that is perpendicular to the longitudinal extension of the frame; a first rack coupled to the frame at the first side portion thereof; and a second rack coupled to the frame at the first side portion thereof; wherein the second rack is spaced from the first rack in a parallel relation and in a second direction that is perpendicular to each of the first direction and the longitudinal extension of the frame; and wherein the second rack faces away from the first rack. According to one aspect, the drilling mast includes a third rack coupled to the frame at the second side portion thereof; and a fourth rack coupled to the frame at the second side portion thereof; wherein the fourth rack is spaced from the third rack in a parallel relation and in the second direction; and wherein the fourth rack faces away from the third rack. According to another aspect, the first and second racks are aligned with the third and fourth racks, respectively, in the second direction.

The present disclosure also introduces an apparatus including a tower extending longitudinally along a first axis, the tower including first and second racks spaced in a parallel relation and facing away from each other; a top drive to assemble or disassemble a string of tubular members, the top drive being movable along the first axis and relative to the tower; first and second electric motors coupled to the top drive and movable therewith; and first and second pinions operably coupled to the first and second electric motors, respectively, and engaged with the first and second racks, respectively, to move the top drive along the first axis and relative to the tower. According to one aspect, the apparatus includes a carriage to which each of the top drive and the first and second electric motors is coupled. According to another aspect, the first and second electric motors are spaced from each other in a direction that is perpendicular to the first axis; and wherein the first and second pinions are spaced from each other in the direction. According to yet another aspect, the first and second electric motors are spaced from each other in a first direction that is parallel to the first axis; wherein the first and second pinions are spaced from each other in the first direction and in a second direction that is perpendicular to the first axis; and wherein the apparatus further includes third and fourth pinions engaged with the first and second racks, respectively, wherein the third and fourth pinions are spaced from each other in each of the first and second directions. According to still yet another aspect, the apparatus includes a carriage coupled to the tower; a linking member pivotally coupled to the carriage to permit the linking member to pivot between first and second pivot positions about a second axis that is perpendicular to the first axis; and wherein the top drive extends longitudinally in a parallel relation to the tower; and wherein the top drive is pivotally coupled to the linking member to permit the top drive to continue to extend longitudinally in a parallel relation to the tower when the linking member pivots between the first and second pivot positions. According to still yet another aspect, the top drive is spaced from the tower by first and second spacings when the linking member is in the first and second pivot positions, respectively, the first and second spacings extending in a direction that is perpendicular to the first axis; and wherein the second spacing is greater than the first spacing. According to still yet another aspect, the apparatus includes at least one actuator extending between the carriage and the linking member to pivot the linking member between the first and second pivot positions. According to still yet another aspect, the apparatus includes a base to which the tower is pivotally coupled to pivot the tower between first and second pivot positions, the tower including a first portion; and a second portion pivotally coupled to the first portion to pivot the second portion between third and fourth pivot positions when the tower is in the first pivot position; and wherein the top drive is movable along each of the first and second portions of the tower when the second portion is in the fourth pivot position.

The present disclosure also introduces a method including providing a tower extending longitudinally along a first axis, the tower including first and second racks spaced in a parallel relation and facing away from each other; providing a top drive to assemble or disassemble a string of tubular members, the top drive being movable along the first axis and relative to the tower; coupling first and second electric motors to the top drive; operably coupling first and second pinions to the first and second electric motors, respectively; and engaging the first and second pinions with the first and second racks, respectively, to move at least the top drive and the first and second electric motors along the first axis and relative to the tower. According to one aspect, the method includes coupling a carriage to the top drive and the first and second electric motors. According to another aspect, the first and second electric motors are spaced from each other in a direction that is perpendicular to the first axis; and wherein the first and second pinions are spaced from each other in the direction. According to yet another aspect, the first and second electric motors are spaced from each other in a first direction that is parallel to the first axis; wherein the first and second pinions are spaced from each other in the first direction and in a second direction that is perpendicular to the first axis; and wherein the method further includes engaging third and fourth pinions with the first and second racks, respectively, so that the third and fourth pinions are spaced from each other in each of the first and second directions. According to still yet another aspect, the method includes coupling a carriage to the tower; pivotally coupling a linking member to the carriage to permit the linking member to pivot between first and second pivot positions about a second axis that is perpendicular to the first axis; and pivotally coupling the top drive to the linking member so that the top drive extends longitudinally in a parallel relation to the tower, the top drive being pivotally coupled to the linking member to permit the top drive to continue to extend longitudinally in a parallel relation to the tower when the linking member pivots between the first and second pivot positions. According to still yet another aspect, the top drive is spaced from the tower by first and second spacings when the linking member is in the first and second pivot positions, respectively, the first and second spacings extending in a direction that is perpendicular to the first axis; and wherein the second spacing is greater than the first spacing. According to still yet another aspect, the method includes extending at least one actuator between the carriage and the linking member to pivot the linking member between the first and second pivot positions. According to still yet another aspect, the tower includes a first portion and a second portion pivotally coupled thereto; and wherein the method further includes pivoting the tower between first and second pivot positions; pivoting the second portion between third and fourth pivot positions when the tower is in the first pivot position; and moving the top drive along each of the first and second portions of the tower when the second portion is in the fourth pivot position.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

What is claimed is:

1. An apparatus comprising:

a tower extending longitudinally along a first axis, the tower comprising first and second racks spaced in a parallel relation and facing away from each other;

a top drive to assemble or disassemble a string of tubular members, the top drive being movable along the first axis and relative to the tower;

first and second electric motors coupled to the top drive and movable therewith;

first and second pinions operably coupled to the first and second electric motors, respectively, and engaged with the first and second racks, respectively, to move the top drive along the first axis and relative to the tower;

a carriage coupled to the tower; and a linking member pivotally coupled to the carriage to permit the linking member to pivot between first and second pivot positions about a second axis that is perpendicular to the first axis; and wherein the top drive extends longitudinally in a parallel relation to the tower; and wherein the top drive is pivotally coupled to the linking member to permit the top drive to continue to extend longitudinally in a parallel relation to the tower when the linking member pivots between the first and second pivot positions.

2. The apparatus of claim 1, wherein the carriage is coupled to each of the first and second electric motors.

3. The apparatus of claim 1 wherein the first and second electric motors are spaced from each other in a direction that is perpendicular to the first axis; and wherein the first and second pinions are spaced from each other in the direction.

4. The apparatus of claim 1 wherein the first and second electric motors are spaced from each other in a first direction that is parallel to the first axis;

wherein the first and second pinions are spaced from each other in the first direction and in a second direction that is perpendicular to the first axis; and wherein the apparatus further comprises third and fourth pinions engaged with the first and second racks, respectively, wherein the third and fourth pinions are spaced from each other in each of the first and second directions.

5. The apparatus of claim 1 wherein the top drive is spaced from the tower by first and second spacings when the linking member is in the first and second pivot positions, respectively, the first and second spacings extending in a direction that is perpendicular to the first axis; and wherein the second spacing is greater than the first spacing.

6. The apparatus of claim 1 further comprising:

at least one actuator extending between the carriage and the linking member to pivot the linking member between the first and second pivot positions.

7. The apparatus of claim 1 further comprising:

a base to which the tower is pivotally coupled to pivot the tower between first and second pivot positions, the tower comprising:

a first portion; and a second portion pivotally coupled to the first portion to pivot the second portion between third and fourth pivot positions when the tower is in the first pivot position; and wherein the top drive is movable along each of the first and second portions of the tower when the second portion is in the fourth pivot position.

8. A method, comprising:

providing a tower extending longitudinally along a first axis, the tower comprising first and second racks spaced in a parallel relation and facing away from each other;

providing a top drive to assemble or disassemble a string of tubular members, the top drive being movable along the first axis and relative to the tower;

coupling first and second electric motors to the top drive;

operably coupling first and second pinions to the first and second electric motors, respectively;

engaging the first and second pinions with the first and second racks, respectively, to move at least the top drive and the first and second electric motors along the first axis and relative to the tower;

coupling a carriage to the tower;

pivotally coupling a linking member to the carriage to permit the linking member to pivot between first and second pivot positions about a second axis that is perpendicular to the first axis; and pivotally coupling the top drive to the linking member so that the top drive extends longitudinally in a parallel relation to the tower, the top pivotally coupled to the linking member to permit the top drive to continue to extend longitudinally in a parallel relation to the tower when the linking member pivots between the first and second pivot positions.

9. The method of claim 8 further comprising coupling the carriage to the first and second electric motors.

10. The method of claim 8 wherein the first and second electric motors are spaced from each other in a direction that is perpendicular to the first axis; and wherein the first and second pinions are spaced from each other in the direction.

11. The method of claim 8 wherein the first and second electric motors are spaced from each other in a first direction that is parallel to the first axis;

wherein the first and second pinions are spaced from each other in the first direction and in a second direction that is perpendicular to the first axis; and wherein the method further comprises engaging third and fourth pinions with the first and second racks, respectively, so that the third and fourth pinions are spaced from each other in each of the first and second directions.

12. The method of claim 8 wherein the top drive is spaced from the tower by first and second spacings when the linking member is in the first and second pivot positions, respectively, the first and second spacings extending in a direction that is perpendicular to the first axis; and wherein the second spacing is greater than the first spacing.

13. The method of claim 8 further comprising:

extending at least one actuator between the carriage and the linking member to pivot the linking member between the first and second pivot positions.

14. The method of claim 8 wherein the tower comprises a first portion and a second portion pivotally coupled thereto; and wherein the method further comprises:

pivoting the tower between first and second pivot positions;

pivoting the second portion between third and fourth pivot positions when the tower is in the first pivot position; and moving the top drive along each of the first and second portions of the tower when the second portion is in the fourth pivot position.

* * * * *